US005454854A

United States Patent [19]

Harashima et al.

[11] Patent Number: 5,454,854

[45] Date of Patent: Oct. 3, 1995

[54] METHOD OF REFINING MOLTEN METAL OR MOLTEN ALLOY

[75] Inventors: Kazuumi Harashima; Michitaka Matsuo; Ryoji Arima, all of Futtsu, Japan

[73] Assignee: Nippon Steel Corporation, Tokyo, Japan

[21] Appl. No.: 72,663

[22] Filed: Jun. 3, 1993

Related U.S. Application Data

[63] Continuation of Ser. No. 828,973, filed as Pct/JP91/00734, May 31, 1991, abandoned.

[30] Foreign Application Priority Data

| | | | |
|---|---|---|---|
| May 31, 1990 | [JP] | Japan | 2-143071 |
| May 31, 1990 | [JP] | Japan | 2-143072 |
| Jun. 16, 1990 | [JP] | Japan | 2-158364 |

[51] Int. Cl.[6] ..... C21C 7/04; C21C 7/072; C21C 7/10

[52] U.S. Cl. ..... 75/10.39; 75/511

[58] Field of Search ..... 75/10.39, 511

[56] References Cited

U.S. PATENT DOCUMENTS

| | | | |
|---|---|---|---|
| 3,606,293 | 9/1971 | Erdely | 75/511 |
| 4,104,057 | 8/1978 | Maas et al. | 75/511 |

FOREIGN PATENT DOCUMENTS

| | | |
|---|---|---|
| 0228024 | 7/1987 | European Pat. Off. . |
| 0366293 | 5/1990 | European Pat. Off. . |
| 1508112 | 10/1969 | Germany . |
| 47-7301 | 4/1972 | Japan . |
| 53-11105 | 2/1978 | Japan . |
| 63-134623 | 6/1988 | Japan . |
| 63-140029 | 6/1988 | Japan . |

OTHER PUBLICATIONS

Stahl und Eisen, vol. 106, No. 25, p. 1430, Dec. 22, 1986.

Patent Abstracts of Japan, vol. 14, No. 304 (C–0734) Jun. 29, 1990.

"The Making, Shaping, And Treating Of Steel" W. T. Lankfort, Jr. Ed., pp. 672 to 674 and 682–684, 1985.

Supplementary European Search Report EP 91 91 0194 mailed on Apr. 2, 1993.

*Primary Examiner*—Peter D. Rosenberg

*Attorney, Agent, or Firm*—Kenyon & Kenyon

[57] ABSTRACT

A method of refining a molten metal or a molten alloy through degassing, wherein a gas is blown into a molten metal or a molten alloy contained within a refining container, while stirring by utilizing an electromagnetic force, to superimpose the blown gas onto a molten metal or a molten alloy, and the stirring by an electromagnetic force, to thereby refine the blown gas, and at the same time, increase the residence time of the blown gas in the molten metal or molten alloy bath and homogeneously disperse the blown gas in the molten metal or molten alloy bath.

11 Claims, 15 Drawing Sheets

METHOD OF REFINING MOLTEN METAL OR MOLTEN ALLOY

This application is a continuation of application Ser. No. 07/828,973 filed as Pct/JP91/00734, May 31, 1991, now abandoned.

TECHNICAL FIELD

The present invention relates to a degassing refining of a molten metal or a molten alloy. More specifically, the present invention relates to a method of carbon removal from a molten metal or a molten alloy, (hereinafter collectively referred to as "molten metal") simply and with a high efficiency and a low cost, for removing carbon [C] contained in a molten metal to about 0.01% by weight or removing the molten metal to a very small content (for example, to 0.001% by weight), and to a method of removing hydrogen [H] and nitrogen [N] contained in a molten metal.

BACKGROUND ART

The concentration of carbon contained in a steel should be very low, for example, in the case of a thin steel sheet for use in automobiles and a thin steel sheet for making beverage cans, to improve the workability thereof and prevent an increase of the deep drawing resistance derived from aging.

In general, in the iron industry, a carbon removal treatment (i.e., a decarbonization treatment) is conducted through the use of various vacuum or reduced pressure decarbonization units as described in, for example, "Tekko Binran II-Seisen.Seiko (Handbook of Steel-Pig Iron Making. Steel Making)", 3rd edition, pp. 671–685.

The above-described decarbonization treatment of a molten steel is conducted by removing carbon [C] contained in a molten steel by the following reaction, through the use of oxygen [O] incorporated in a molten steel and various oxidization sources such as iron ore $Fe_xO_y$ and oxygen gas $O_2$.

$$[C]+[O]=CO(\text{gas})$$

$$y[C]+Fe_xO_y=yCO(\text{gas})+xFe \quad (1)$$

$$[C]+\tfrac{1}{2}O_2=CO(\text{gas})$$

Nevertheless, even in the case of vacuum or reduced pressure equipment, the decarbonization rate begins to fall when the carbon content [% C] of the molten steel is 0.015% by weight or less, and further falls to a carbon content [% C] of about 0.005% by weight. Accordingly, to manufacture a low carbon molten steel, the decarbonization treatment time should be prolonged, which lowers the molten steel temperature. Therefore, in general, to compensate for the lowering of the molten steel temperature, the molten steel is reheated in the next step, or the tapping temperature in the previous step is increased. Nevertheless, when the tapping temperature is high, the refractory is subjected to melt loss, and this increases the refractory unit requirements and the cost of the decarbonization treatment.

Thus, even when use is made of vacuum or reduced pressure equipment, the current decarbonization treatment still has problems of efficiency and profitability, and therefore, it is obvious that no practical method exists wherein a molten steel is decarbonized to the above-described carbon content or less under atmospheric pressure.

The denitrogenization-dehydrogenation reaction of a molten metal is also conducted through the utilization of a reduced pressure or vacuum, based on the following reaction formulae:

$$[N]+[N]=N_2(\text{gas}) \quad (2)$$

$$[H]+[H]=H_2(\text{gas}) \quad (3)$$

Nevertheless, the development of a method of manufacturing a molten metal having lower nitrogen/or hydrogen contents, with a high efficiency, is still unknown in the art.

To overcome the above problems of the conventional method, a gas bubbling or gas injection by an inert gas is conducted to increase the area of the gas-liquid reaction interface, and at the same time, the flow rate of the blown gas is increased to enhance the stirring of the molten steel and thereby increase the mass transfer rate of [C] (and [N]), to thus increase the removal reaction rate. Under a reduced pressure or vacuum, the increases in the blown gas flow rate makes it impossible to ensure that the gas-liquid interface area becomes a reaction site, and increases the amount of scattering of the molten steel due to a coalescence of blown gases or blow-through of blown gases, etc., and the molten steel flies out from the container accommodating the molten steel (hereinafter referred to as "ladle") or a layer of metal is deposited on the internal wall of the ladle, which makes it difficult to simultaneously attain the desired reaction rate and a stable refining procedure.

To manufacture a ultra-low carbon steel (and a ultra-low nitrogen steel), it is necessary to prolong the time taken for decarbonization (and denitrogenation) refining, even when this incurs the above-described difficulties. Accordingly, in the prior art method, to compensate for the lowering of the molten steel temperature, the molten steel is reheated in the next step, or a high temperature is used as the temperature of the molten steel tapped from a converter or an electric furnace. When the tapping temperature is high, the refractory of the convertor or the electric furnace is subjected to melting loss, which increases the refractory unit requirements, and accordingly, the cost of the refining. Thus, even when use is made of vacuum or reduced pressure equipment, the existing decarbonization-denitrogenation treatment method is inefficient and nonprofitable to an extent such that it is very difficult to stably manufacture a molten steel having a ultra-low nitrogen content and a ultra-low nitrogen content in a short time.

Further, Japanese Unexamined Patent Publication (Kokai) No. 62 62-156220 discloses the acceleration of a slag/metal reaction in the desulfurization of a molten metal with slag, although this is not related to the decabonization, denitrogenation or dehydrogenation treatment of a molten metal or a molten alloy. The slag/metal reaction disclosed in this document is a liquid-liquid reaction, and impurities to be removed from the molten metal are captured in the slag. Therefore, an increase in the slag/metal contact area increases the rate of removal of the impurities. One means of causing the turbulence of slag/metal is to blow a gas around the interface of the slag and the molten metal, and thus the presence of a slag is indispensable to the method of the present invention.

The following method of the present invention intends to accelerate the degassing reaction (gas-liquid reaction), for example, to allow CO, $N_2$ and $H_2$ formed by the reaction to be absorbed with the blown gas, and is essentially different from the invention of the above-described publication, in the reaction site thereof. Therefore, the turbulence of slag/metal by blowing a gas to increase the slag/metal contact area does not accelerate the degassing reaction, and thus the presence of the slag is not essential but is a useful means of increasing the molten metal/gas contact area.

DISCLOSURE OF THE INVENTION

Accordingly, an object of the present invention is to provide a method of efficiently and simply manufacturing a low carbon molten metal through an elimination of the drawbacks of the above-described methods of purifying a molten metal or a molten alloy, and to provide a method of efficiently manufacturing a molten metal having a lower nitrogen content and a lower hydrogen content.

Other objects and features of the present invention will now be apparent from the following detailed description.

According to the present invention, there is provided a method of refining through degassing a molten metal or a molten alloy, wherein a gas is blown into a molten metal or a molten alloy contained within a refining container, while stirring through the utilization of an electromagnetic force, to superimpose the blowing of a gas into a molten metal or a molten alloy, and the stirring by an electromagnetic force, to thereby refine the blown gas, and at the same time, increase the residence time of the blown gas in the molten metal or molten alloy bath, and homogeneously disperse the blown gas in the molten metal or molten alloy bath.

Namely, the basic technical concept of the present invention resides in the feature that a blown gas is refined and dispersed through the use of a combination of an electromagnetic stirring while blowing a gas, as a means of increasing the gas-liquid interface area, i.e., the degassing reaction site, to thereby increase an area for a gas-liquid interface reaction, and at the same time, to increase the residence time of the refined and dispersed blown gas, to thereby enhance the utilization efficiency of the blown gas and effectively conduct a degassing reaction.

DESCRIPTION OF THE DRAWINGS

The present invention will now be described in more detail with reference to the accompanying drawings:

In FIG. 1, line A represents induction stirring+Ar blowing (plug or lance); line B represents Ar blowing alone (plug or lance); line C represents induction stirring+Ar and $N_2$ or $N_2$ blowing (plug or lance); and line D represents virtual add value;

BEST MODE OF CARRYING OUT THE INVENTION

Figure 18:
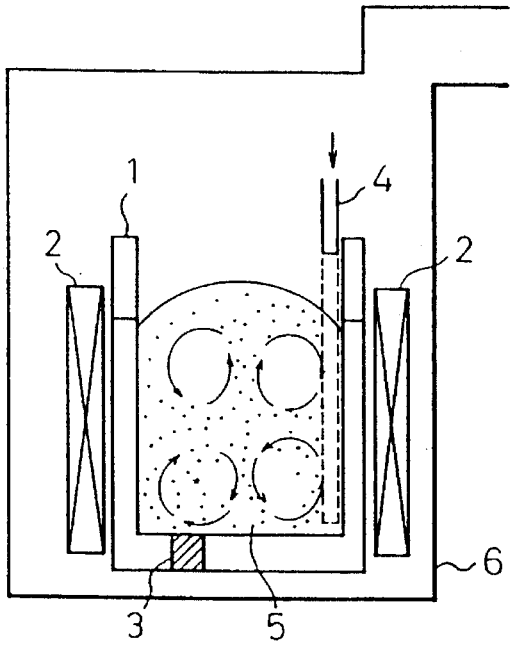
FIG. 18 is a conceptual diagram showing an embodiment of an apparatus for practicing the method of the present invention.

FIG. 18 is a schematic view of an apparatus for practicing the present invention. In FIG. 18, numeral 1 designates a container (ladle) for accommodating a molten metal, numeral 2 a coil for electromagnetic stirring and heating, numeral 3 a gas blowing plug or a gas blowing nozzle, numeral 4 a gas blowing lance, numeral 5 a molten metal to be refined, and numeral 6 a container for housing the ladle provided such that a reduced pressure or vacuum is applied.

In the present invention, the effect of the electromagnetic stirring is important.

Figure 1:
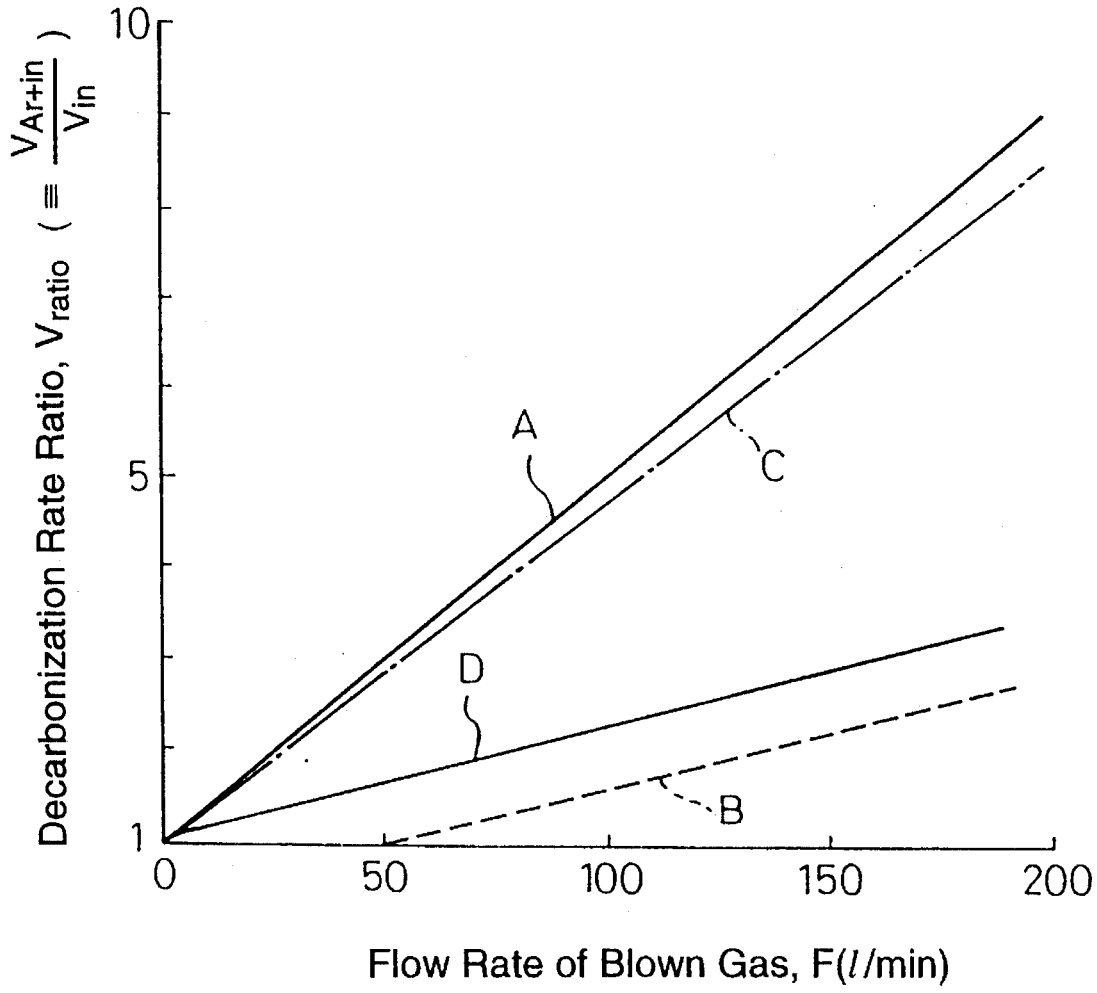
FIG. 1 is a graph showing the relationship between the blown gas flow rate, F, and the decarbonization rate, $V_{ratio}$, under electromagnetic stirring, in Example 1.

To increase the reaction rate, it is necessary to enhance the stirring of the molten metal, and at the same time, to increase the reaction interface area, and gas bubbling or gas injection has hitherto been conducted for this purpose. In the conventional methods, however, the gas-liquid interface area, i.e., the reaction site, cannot be ensured due to the coalescence, blow-through and other phenomena of blown gases, even when the blown gas flow rate is increased, and thus, as shown in the Comparative Example of FIG. 1, the decarbonization rate is very low. On the other hand, as shown in FIG. 1, a combination of electromagnetic stirring with gas blowing, as in the present invention, brings a remarkable increase in the decarbonization rate, due to the following effects:

(1) a blown gas is carried away by the flow of the molten metal caused by the electromagnetic stirring, and finely dispersed within the molten metal to thereby increase the gas-liquid reaction interface area; and (2) a fine bubble is carried on the flow of the molten metal caused by the electromagnetic stirring, to increase the residence time in the molten metal. The above-described effects are the same even when the ladle is provided under reduced pressure or vacuum. In this case, a greater improvement in the decarbonization rate can be attained due to an additional blown gas expanding effect.

Figure 2:
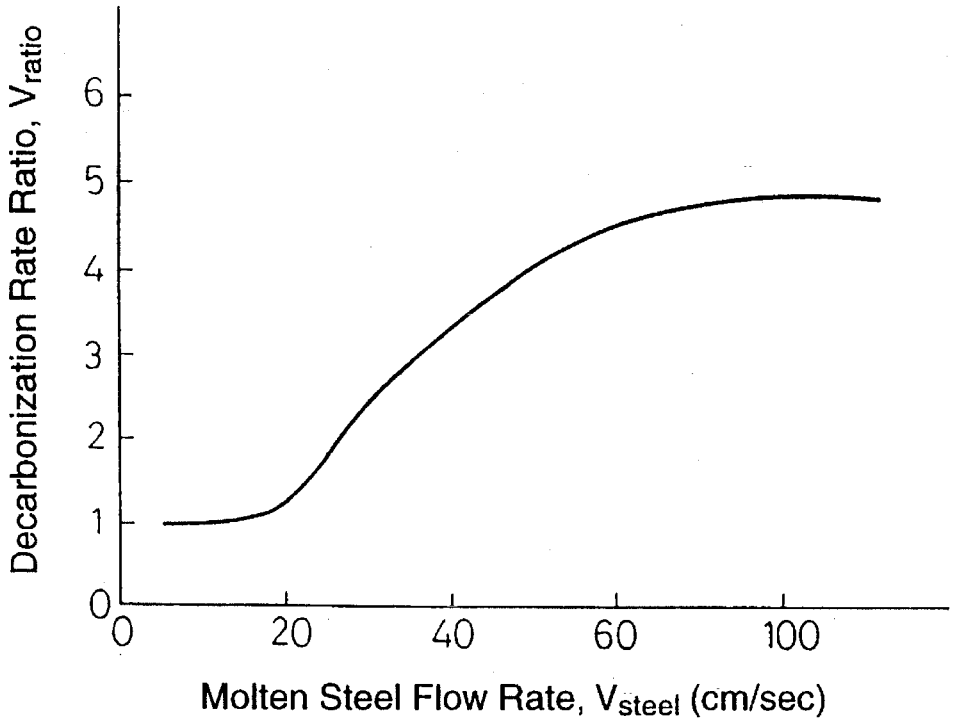
FIG. 2 is a graph showing the relationship between the molten steel flow rate (molten steel surface flow rate), $V_{steel}$, and the decarbonization rate ratio, $V_{ratio}$, in Example 2.

Since the fine dispersion effect of the blown gas depends upon the flow rate of the molten metal, the flow rate of the molten metal may be used as a measure of the strength of the electromagnetic stirring. As shown in FIG. 2, with respect to the strength of the electromagnetic stirring, the application of an electric power capable of providing a molten metal flow rate of 20 cm/sec or more to the coil brings a significant improvement in the decarbonization rate.

The flow rate of the molten metal can be determined by putting a particle less liable to dissolve, for example, CaO particle, MgO particle or a graphite particle, on the surface of the molten metal, and determining the flow rate of the molten metal from the migration rate.

Figure 19A:
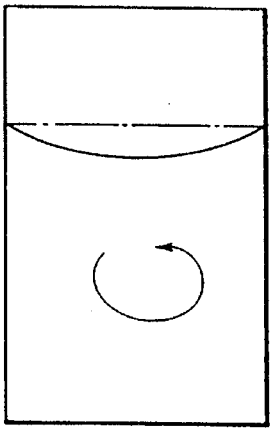
FIG. 19 is a conceptual diagram showing an electromagnetic stirring system for practicing the method of the present invention, wherein (a) shows electromagnetic stirring by using electromagnetic stirring in the azimuthal direction by travelling an electromagnetic field, (b) shows electromagnetic stirring by using electromagnetic stirring in the vertical direction by travelling an electromagnetic field, and (c) shows electromagnetic stirring as in a coreless induction field.
Figure 19B:
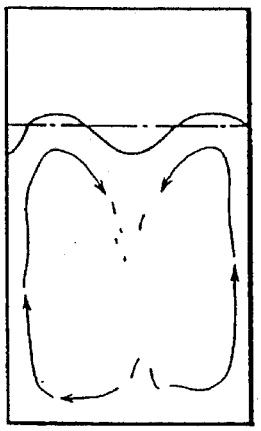
Figure 19C:
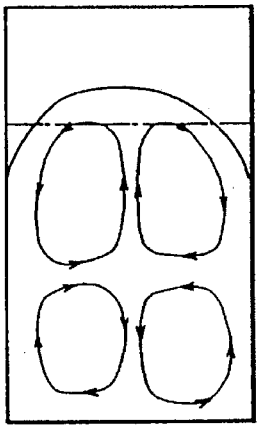

As shown in FIGS. 19(*a*), (*b*) and (*c*), the electromagnetic stirring systems useful to the present invention are:

(a) electromagnetic stirring by using an electromagnetic stirring in the azimuthal direction by travelling an electromagnetic field;

(b) an electromagnetic stirring by using an electromagnetic stirring in the vertical direction by travelling electromagnetic field; and (c) an electromagnetic stirring by using an electromagnetic direction by travelling electromagnetic field.

The gas blowing method is also important to the method of the present invention.

The gas blowing method should basically make the most efficient use of the residence time of the bubbles, i.e., the reaction time.

The gas blowing position should be located at a portion as deep as possible in the molten metal, to thus prolong the residence time of bubbles produced by a fine dispersion and increase the amount of gas components (Co, $N_2$ and $H_2$) absorbed.

Figure 5:
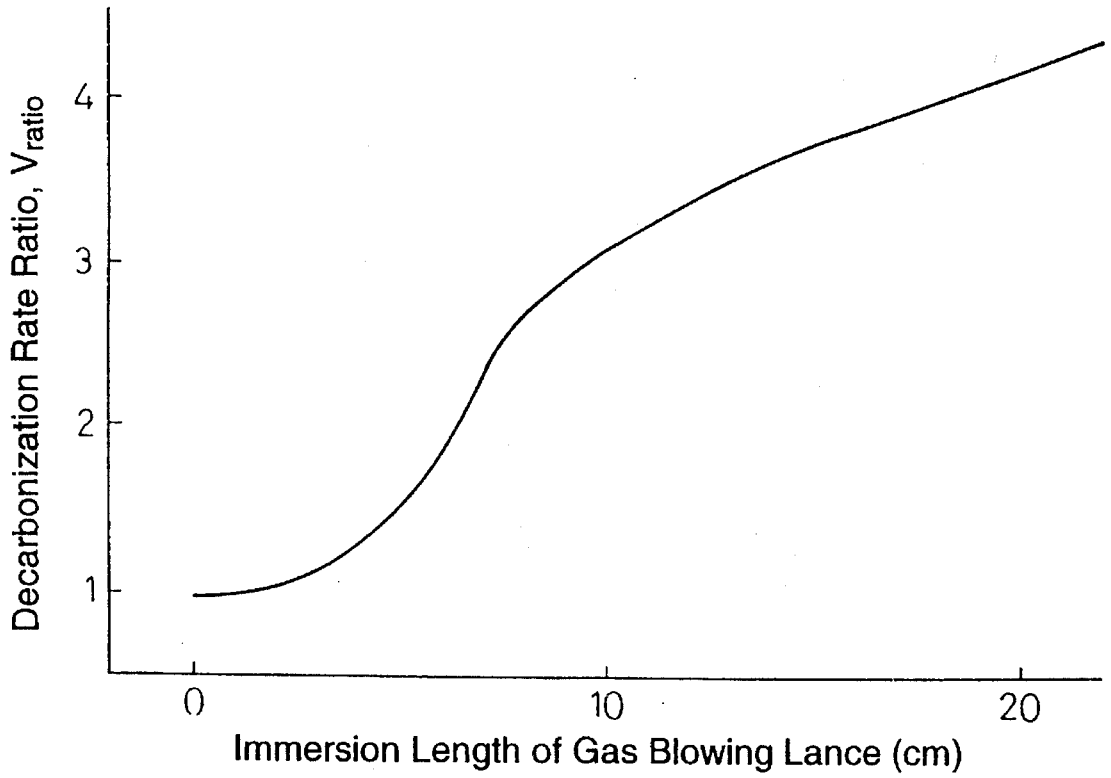
FIG. 5 is a graph showing the relationship between the decarbonization rate ratio, $V_{ratio}$, and the immersion length of a lance in Example 5.

As shown in FIG. 5, the decarbonization rate increases with an increase of the depth of the gas blowing position in the molten metal. Therefore, preferably the gas blowing position is provided at the bottom of the container for accommodating the molten metal, or at a depth of at least 10 cm or more from the free surface of the molten metal.

In the practice of the present invention, this effect can be exhibited when a porous plug made of a refractory, a plug equipped with a porous nozzle buried in a refractory, an immersion lance made of a refractory, or an immersion lance coated with a refractory is used as the gas blowing means.

Figure 3:
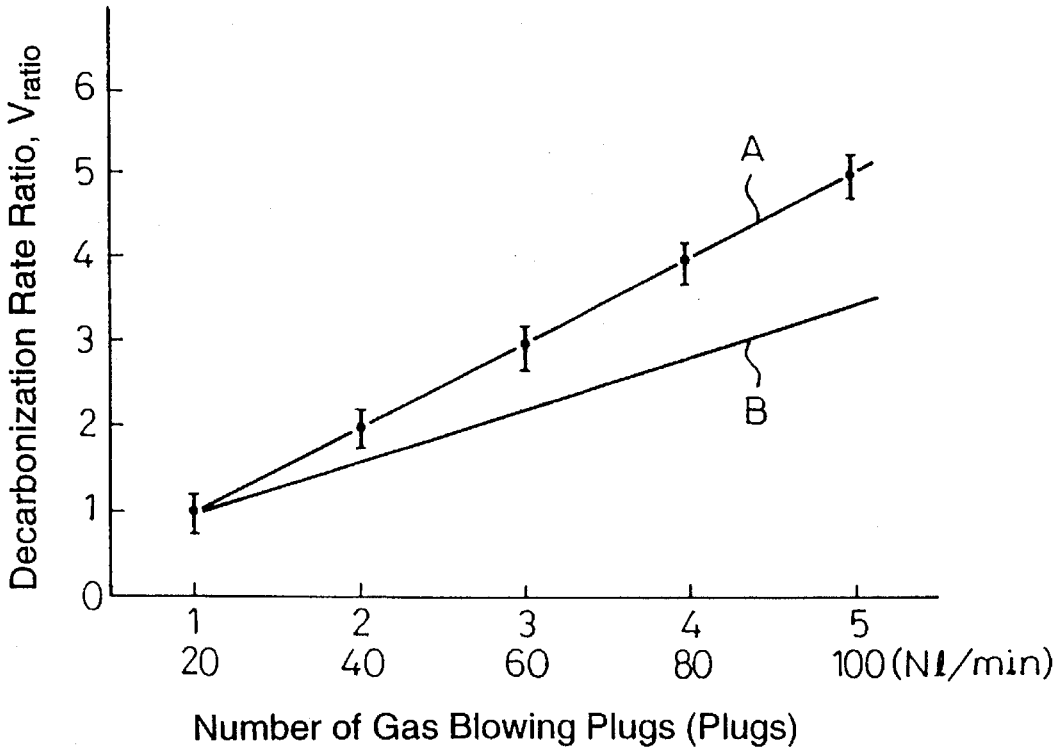
FIG. 3 is a graph showing the relationship between the decarbonization rate ratio, $V_{ratio}$, and the number of blowing plugs, in Example 3.

In the method of the present invention, as shown in FIG. 3, since the reaction rate increases with an increased amount of blown gas, the amount of blown gas may be selected to match the intended refining time. In this case, blowing the gas through a plurality of plugs is more effective, from the viewpoint of a more efficient blowing of the gas.

The blown gas used in the method of the present invention varies, depending upon the type of intended degassing treatment.

In the case of the decarbonization treatment, it is possible to use an inert gas alone or a mixed gas comprising an inert gas, and added thereto, an oxygen-containing gas.

It is generally preferred to use argon as the inert gas and oxygen gas or a mixed gas comprising an inert gas and oxygen gas as an oxygen-containing gas. Further, it is also possible to separately use an oxygen-containing gas simultaneously with the blown gas.

In general, it is preferred to use argon as the inert gas and oxygen gas or a mixed gas comprising an inert gas and oxygen gas. As shown in FIG. 1, the same effect can be attained when nitrogen gas or hydrogen gas is used as an alternative to the argon gas. In particular, when the [O] content of the molten metal is 0.03% by weight or more, the rate of the nitrogen absorption derived from the reverse reaction of the above-described formula (2) is so small that a sufficient increase of the effect of the decarbonization reaction can be attained. Therefore, a part or the whole of the argon may be replaced with nitrogen gas.

Figure 6:
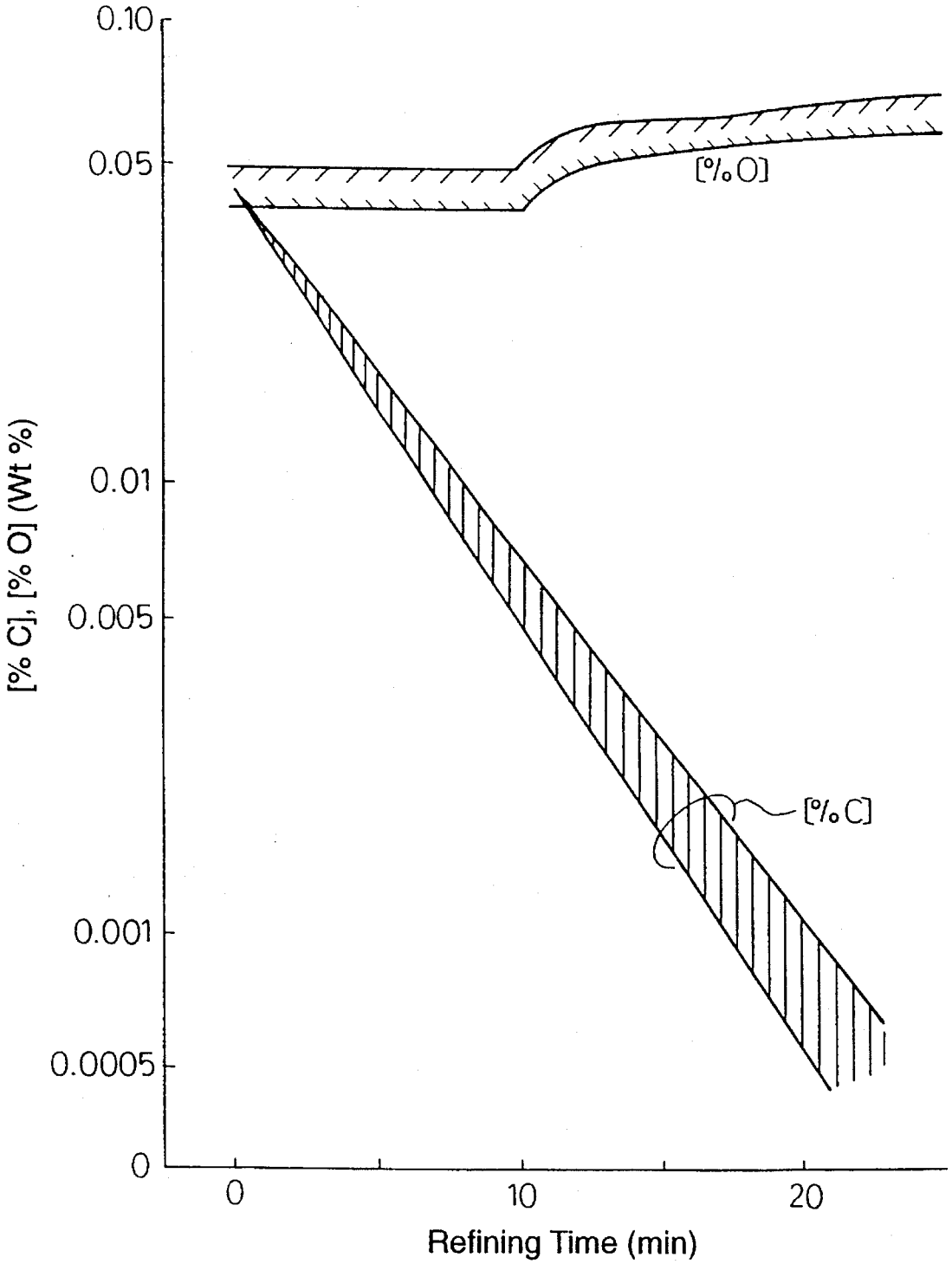
FIG. 6 is a graph showing the relationship between the refining time and the [C] content and [O] content where the electromagnetic stirring method is varied in Example 6.

In the decarbonization treatment, as shown in FIG. 6, when the initial [C] content is high and the amount of decarbonization is large, or when the [O] content is low, a desired decarbonization rate can be obtained by ensuring the [O] content through a blowing or blasting of oxygen gas or an addition of a solid oxide represented by iron ore, manganese ore, chromium ore, etc., to the molten gas.

In the case of the denitrogenation treatment, it is possible to use an inert gas alone or a mixed gas comprising an inert gas, and added thereto, an oxygen-containing gas. It is also possible to separately use an oxygen-containing gas simultaneously with the above-described blowing gas. Generally, it is preferable to use argon as the inert gas and oxygen gas or a mixed gas comprising an inert gas and oxygen gas as the oxygen-containing gas. Further, in this case, the same effect can be attained when, in the inert gas, a part or the whole of the argon gas is replaced with CO gas or $CO_2$ gas. The use of nitrogen gas and air, however, is unfavorable.

In the case of the dehydrogenation treatment, it is possible to use an inert gas alone or a mixed gas comprising an inert gas, and added thereto, an oxygen-containing gas. In this case, it is preferable to use argon as the inert gas and a mixed gas comprising oxygen gas and an inert gas as the oxygen-containing gas. Further, the same effect can be attained when, in the inert gas, a part or the whole of the argon gas is replaced with $N_2$ gas, CO gas or $CO_2$ gas.

The method of the present invention can be conducted not only when refining through degassing under atmospheric pressure but also under a reduced pressure or an industrially obtainable vacuum, and thus the method of the present invention is very versatile.

EXAMPLES

The present invention will now be described in more detail with reference to the following Examples, by which the present invention is no way limited.

Example 1 (Effect of Electromagnetic Stirring and Ar Blowing and Influence of Bloom Gas Species)

A ladle (capacity: diameter 120 cm, depth 200 cm) was charged with 8 tons of a molten steel having a composition comprising 0.015% by weight of carbon [C], 0.04% by weight of oxygen [O] and 0.006% by weight of sulfur [S], and refining was conducted while varying the Ar gas flow rate bloom into the molten steel, where (1) a gas blowing plug was provided at the bottom; and (2) a lance was immersed to a depth of 20 cm or more from the bottom of the ladle; while carrying out an electromagnetic stirring under atmospheric pressure (conditions: type shown in FIGS. 19(*b*) and (*c*), $V_{steel}$= 30–40 cm/sec, power=500–800 kW).

The relationship between the blown Ar gas flow rate, $F_{Ar}$ (liter/min), and the decarbonization rate ratio, $V_{ratio}$, is shown in FIG. 1. The decarbonization rate ratio, $V_{ratio}$, represents the ratio of the decarbonization rate, $V_{Ar+in}$, obtained in the case of a combination of electromagnetic stirring with Ar blowing to the decarbonization rate, $V_{in}$, in the case of electromagnetic stirring without Ar blowing, i.e., $$V_{ratio} = \frac{V_{Ar+in}}{V_{in}}$$

As indicated by a straight line A of FIG. 1, the $V_{ratio}$ increases with an increase of $F_{Ar}$, and the decarbonization rate ratio in the case of a plug was substantially the same as that in the case of a lance.

For comparison, only the blowing of Ar gas from the plug was conducted, without electromagnetic stirring. As indicated by a straight line B of FIG. 1, the increase in the decarbonization rate in this case was very small, and in the case of the blowing of Ar gas alone, the molten steel was violently scattered, and thus it was difficult to ensure a flow rate, $F_{Ar}$, of 200 (liter/min) or more.

The relationship between the blown gas flow rate, F (liter/min), and the decarbonization rate ratio, $V_{ratio}$, where a mixed gas comprising Ar and $N_2$ (volume ratio=70:30) and an $N_2$ gas alone (electromagnetic stirring was conducted under the same condition as described above) were blown instead of the blown Ar gas are indicated by a dashed line C in FIG. 1. As indicated by a chain line C of FIG. 1, the degree of increase in the $V_{ratio}$ was substantially the same as that in the case of blowing Ar alone. A straight line D of FIG. 1 represents a virtual add value of the electromagnetic stirring effect and the Ar gas blowing effect.

EXAMPLE 2 (Effect of Flow Rate of Molten Steel)

A container (capacity: 120 cmϕ×200 cmL) equipped with a gas blowing plug at the bottom of the container was charged with 8 tons of a molten steel having a composition comprising 0.015% by weight of carbon [C], 0.04% by weight of oxygen [O] and 0.006% by weight of sulfur [S], and refining was conducted at a constant flow rate of Ar, $F_{Ar}$, blown from the plug of 100 (liter/min) with a variation in the electromagnetic stirring power, while electromagnetic stirring under atmospheric pressure (conditions: type shown in FIGS. 19(*a*), (*b*) and (*c*), power=0–2400 kW). The relationship between the molten steel flow rate, $V_{steel}$, and the decarbonization rate ratio, $V_{ratio}$, is shown in FIG. 2.

The decarbonization rate, $V_{ratio}$, represents the ratio of the decarbonization rate, $V_{Ar+in}$, obtained in the case of a combination of the electromagnetic stirring with the blowing of Ar to the decarbonization rate, $V_{Ar}$, obtained in the case where only Ar is blown from the plug, i.e., $V_{Ar+in}/V_{Ar}$.

As shown in FIG. 2, the $V_{ratio}$ value rapidly increased when the $V_{steel}$ value became 20 (cm/sec) or more.

EXAMPLE 3 (Effect of Number of Plugs)

A container (capacity: 120 cmϕ×200 cmL) equipped with a plurality of gas blowing plugs at the bottom of the container was charged with 8 tons of a molten steel having a composition comprising 0.015% by weight of carbon [C], 0.04% by weight of oxygen [O] and 0.006% by weight of sulfur [S], and refining was conducted by feeding Ar gas in an amount of 20 (N liter/min) per plug with electromagnetic stirring under atmospheric pressure (conditions: type shown in FIGS. 19(*b*) and (*c*), $V_{steel}$=40 cm/sec, power=800 kW).

The relationship between the decarbonization ratio, $V_{ratio}$, and the number of plugs is indicated as a straight line A of FIG. 3. The decarbonization rate ratio, $V_{ratio}$, represents the ratio of the decarbonization rate, $V^n_{Ar+in}$, obtained at that time to the decarbonization rate, $V_{Ar+in}$, obtained when one plug was used, i.e., $V^n_{Ar+in}/V_{Ar+in}$. As shown in FIG. 3, the $V_{ratio}$ increased with an increase of the number of plugs. For comparison, the decarbonization rate ratio where the whole quantity of the Ar gas was blown through one plug is indicated by a straight line B of FIG. 3. As apparent from FIG. 3, when the amount of blown Ar gas is constant, the dispersion of the gas blowing positions is advantageous.

EXAMPLE 4 (Effect of Combined Use of Oxygen Gas)

A container (capacity: 120 cmϕ×200 cmL) equipped with a gas blowing plug at the bottom of the container was charged with 8 tons of a molten steel having a composition comprising 0.041% by weight of carbon [C], 0.04% by weight of oxygen [O] and 0.006% by weight of sulfur [S], and the molten steel was refined by blowing a mixed gas comprising Ar gas and oxygen in a total amount of 200 (N liter/min) through two plugs while conducting electromagnetic stirring under atmospheric pressure (condition: type shown in FIG. 19(*c*), $V_{steel}$=40 cm/sec, power=800 kW). The oxygen concentration of the mixed gas was from 5% to 40%.

Figure 4:
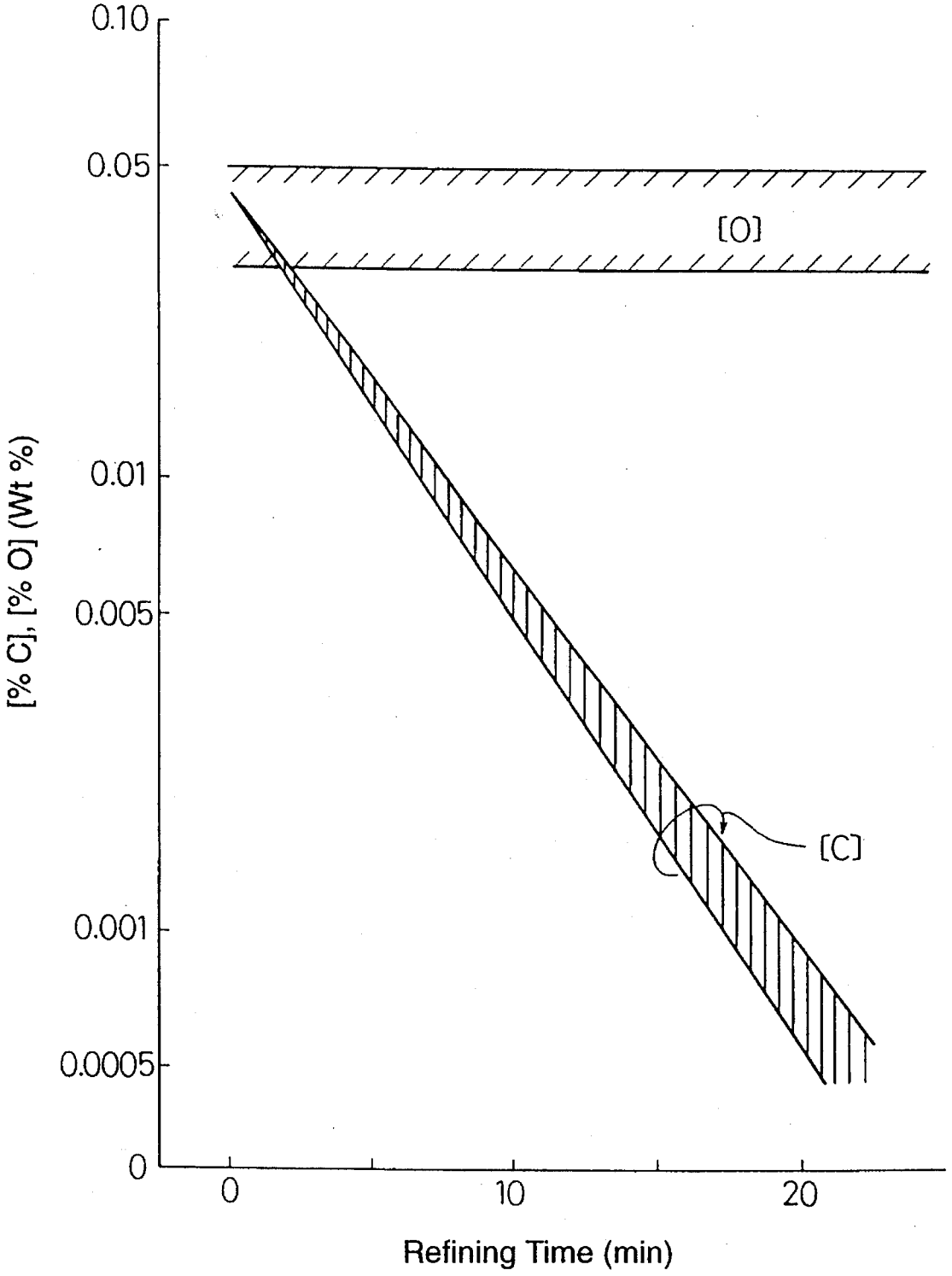
FIG. 4 is a graph showing the relationship between the refining time and the [C] content and [O] content where the [O] content in a mixed gas is varied in Example 4.

Further, the change of the [C] content and the [O] content with the refining time in a region where the [C] content is 0.005 ppm or less is shown in FIG. 4.

Regardless of the oxygen concentration of the fed mixed gas, when the oxygen concentration was maintained at a constant value, a ultra-low carbon molten steel having a [C] content of 0.0010% by weight was obtained by a decarbonization treatment for 20 min.

EXAMPLE 5 (Effect of Depth of Lance)

A container (capacity: 120 cmϕ×200 cmL) was charged with 8 tons of a molten steel having a composition comprising 0.015% by weight of carbon [C], 0.04% by weight of oxygen [O] and 0.006% by weight of sulfur [S], and the molten steel was refined by feeding Ar gas at a flow rate of 200 (N liter/min) through an immersion lance while conducting electromagnetic stirring under atmospheric pressure (conditions: type shown in FIG. 19(*c*), $V_{steel}$=30–40 cm/sec, power=500–800 kW) while varying the immersion depth of a lance for blowing a gas.

The relationship between the decarbonization rate ratio, $V_{ratio}$, and the immersion depth of the lance is shown in FIG. 5. The decarbonization rate ratio, $V_{ratio}$, represents the ratio of the decarbonization rate, $V_{Ar+in}$, obtained in the case of a variation in the immersion depth to the decarbonization rate ratio, $V_{AR}o_{+in}$, obtained when the lance was not used, i.e., $V_{Ar+in}/V_{Ar}o_{+}$. As apparent from the results shown in FIG. 5, the $V_{ratio}$ value became larger when the immersion depth of lance was 10 cm or more.

EXAMPLE 6 (Effect of Type of Electromagnetic Stirring)

A container (capacity: 120 cmϕ×200 cmL) equipped with a gas blowing plug at the bottom of the container was charged with 8 tons of a molten steel having a composition comprising 0.045% by weight of carbon [C], 0.045% by weight of oxygen [O] and 0.016% by weight of sulfur [S], and the molten steel was refined by blowing Ar gas though two plugs at a total flow rate of 200 (N liter/min) while conducting electromagnetic stirring with various stirring patterns as shown in FIGS. 19(*a*) to (*c*) under atmospheric pressure (conditions: $V_{steel}$=30 cm/sec, power=800 kW) and feeding iron ore to the molten steel through a lance (immersion depth: 20 cm) provided at the upper part by using Ar gas as a carrier gas. The change of the [C] content and [O] content with time is shown in FIG. 6.

As shown in FIG. 6, a ultra-low carbon molten steel having a [C] content of 0.0010% by weight or less was obtained by a decarbonization treatment for 20 min., regardless of the type of electromagnetic stirring method used.

EXAMPLE 7 (Effect of Electromagnetic Stirring and Ar Blowing and Influence of Blown Gas Species)

Figure 8:
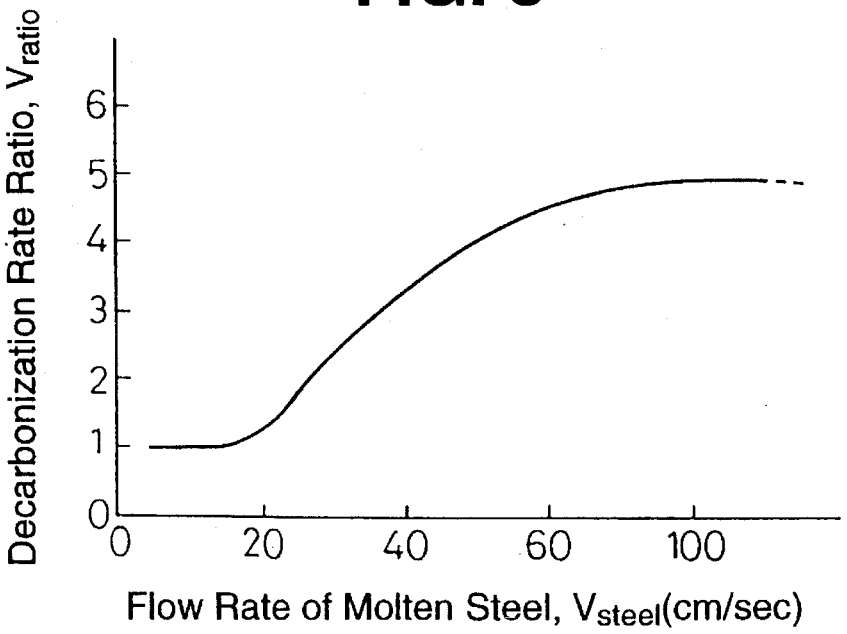
FIG. 8 is a graph showing the relationship between the molten steel flow rate (molten steel surface flow rate), $V_{steel}$, and the decarbonization rate ratio, $V_{ratio}$, in Example 8.

A ladle (capacity: 120 cmϕ×200 cmL) was charged with 8 tons of a molten steel having a composition comprising 0.015% by weight of carbon [C], 0.04% by weight of oxygen [O] and 0.006% by weight of sulfur [S], and refining was conducted with variation in the flow rate of Ar gas blown into the molten steel where (1) a gas blowing plug was provided at the bottom; and (2) a lance was immersed in a depth of 20 cm from the bottom of the ladle, in such a manner as shown in FIG. 8, while conducting electromagnetic stirring under a pressure of 10 mmHg and a vacuum of 1 mmHg or less (conditions: type shown in FIGS. 19(*b*) and (*c*), $V_{steel}$ =30–40 cm/sec, power=500–800 kW).

Figure 7:
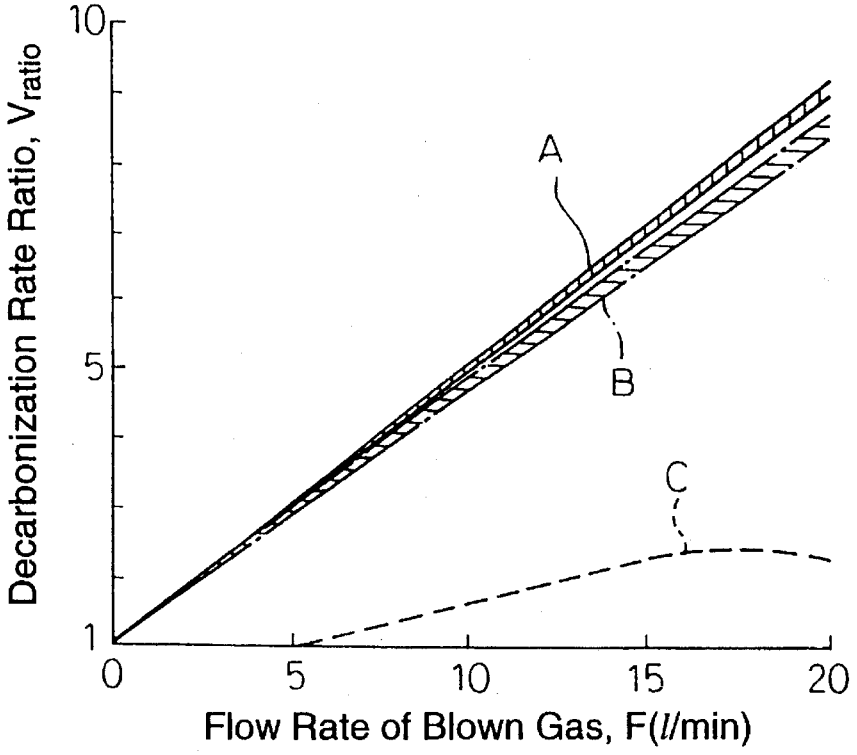
FIG. 7 is a graph showing the relationship between the flow rate, F, of a gas blown through a plug and the decarbonization rate ratio, $V_{ratio}$, in Example 7.

The relationship A between the Ar gas flow rate, $F_{Ar}$ (liter/min), and the decarbonization rate ratio, $V_{ratio}$, is shown in FIG. 7. The decarbonization rate ratio, $V_{ratio}$, represents the decarbonization rate, $V_{Ar+in}$, obtained in the case of the electromagnetic stirring and Ar blowing to the decarbonization rate, $V_{in}$, obtained in the case of the electromagnetic stirring alone without blowing Ar, i.e., $V_{Ar+in}/V_{in}$. As shown in FIG. 7, the $V_{ratio}$ value increases with an increase of the $F_{Ar}$ value, and the decarbonization rate ratio for the plug was substantially the same as that for the lance.

The relationship B between the blowing gas flow rate, F (liter/min), and the decarbonization rate ratio, $V_{ratio}$, where a mixed gas comprising Ar and $N_2$ (a volume ratio of 60:40) and an $N_2$ gas alone were blown instead of the Ar gas is shown in FIG. 7. The degree of increase in the $V_{ratio}$ was substantially the same as that in the case of the blowing of Ar alone.

For comparison, the relationship between the $V_{ratio}$ and the $F_{Ar}$ in the case of the blowing of Ar alone without electromagnetic stirring is indicated by a broken line C. In this case, the degree of increase in the $V_{ratio}$ was very small even when the $F_{Ar}$ was increased, and the amount of scattering of the molten steel was increased, and in the case of an $F_{Ar}$ value of 15 (liter/min) or more, it was difficult to stably conduct the refining.

EXAMPLE 8 (Influence of Stirring Force).

A container (capacity: 120 cmϕ×200 cmL) equipped with a gas blowing plug at the bottom thereof was charged with 8 tons of a molten steel having a composition comprising 0.015% by weight of carbon [C], 0.04% by weight of oxygen [O] and 0.006% by weight of sulfur [S], and the molten steel was refined at a constant flow rate of Ar, $F_{Ar}$ (liter/min), blown from the plug 10 (liter/min) while conducting an electromagnetic stirring under a reduced pressure of 20 mmHg (conditions: type shown in FIGS. 19(*a*), (*b*) and (*c*), power=0–2400 kW) while varying the electromagnetic stirring power to thus vary the molten steel flow rate, $V_{steel}$ (cm/sec). The relationship between the $V_{steel}$ and the $V_{ratio}$ is shown in FIG. 8. The decarbonization rate, $V_{ratio}$, represents the ratio of the decarbonization rate, $V_{Ar+in}$, obtained in the case of a combination of the electromagnetic stirring with the blowing of Ar to the decarbonization rate, $V_{Ar}$, obtained in the case of the blowing of Ar alone through the plug, i.e., $V_{Ar+in}/V_{Ar}$.

As shown in FIG. 8, the $V_{ratio}$ value rapidly increases when the $V_{steel}$ value becomes 20 (cm/sec) or more.

EXAMPLE 9 (Influence of Number of Plugs)

A container (capacity: 120 cmϕ×200 cmL) equipped with a plurality of gas blowing plugs at the bottom of the container was charged with 8 tons of a molten steel having a composition comprising 0.015% by weight of carbon [C], 0.04% by weight of oxygen [O] and 0.006% by weight of sulfur [S], and refining was conducted by feeding Ar gas in an amount of 5 (N liter/min) per plug with an electromagnetic stirring under a vacuum of 0.1 mmHg or less (conditions: type shown in FIGS. 19(*c*), $V_{steel}$=30 cm/sec, power= 600 kW).

Figure 9:
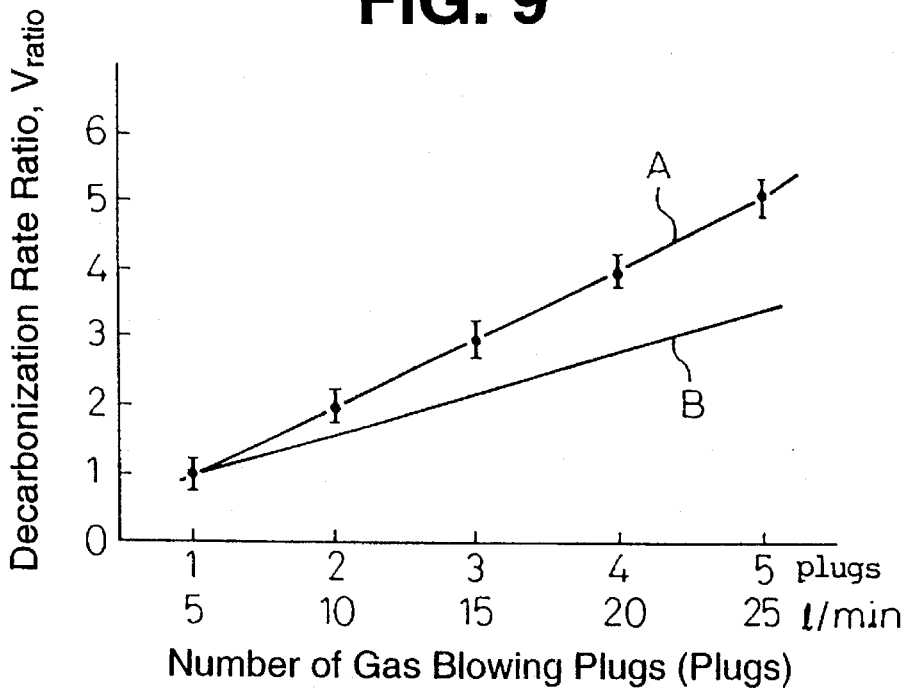
FIG. 9 is a graph showing the relationship between the decarbonization rate ratio, $V_{ratio}$, and the number of blowing plugs in Example 9.

The relationship between the decarbonization ratio, $V_{ratio}$, and the number of plugs is indicated by a straight line A of FIG. 9. The decarbonization rate ratio, $V_{ratio}$, represents the ratio of the decarbonization rate, $V^{n}_{Ar+in}$, obtained at that time to the decarbonization rate, $V_{Ar+in}$, obtained when one plug was used, i.e., $V^{n}_{Ar+in}/V_{Ar+in}$. As shown in FIG. 9, the $V_{ratio}$ value increases with an increase in the number of plugs.

For comparison, the decarbonization rate ratio in the case where the whole quantity of the Ar gas was blown through one plug is indicated by a straight line B of FIG. 9. As apparent from FIG. 9, when the amount of blown Ar gas is constant, a dispersion of the gas blowing positions is more advantageous.

EXAMPLE 10 (Influence of Gas Blowing Depth)

A container (capacity: 120 cmϕ×200 cmL) was charged with 8 tons of a molten steel having a composition comprising 0.015% by weight of carbon [C], 0.045% by weight of oxygen [O] and 0.006% by weight of sulfur [S], and the molten steel was refined by feeding Ar gas at a flow rate of 10 (N liter/min) through an immersion lance while conducting an electromagnetic stirring under a reduced pressure of 50 mmHg (conditions: type shown in FIGS. 19(*b*) and (*c*), $V_{steel}$=40 cm/sec, power=800 kW), while varying the depth of the gas blowing plug and the immersion depth of the lance.

Figure 10:
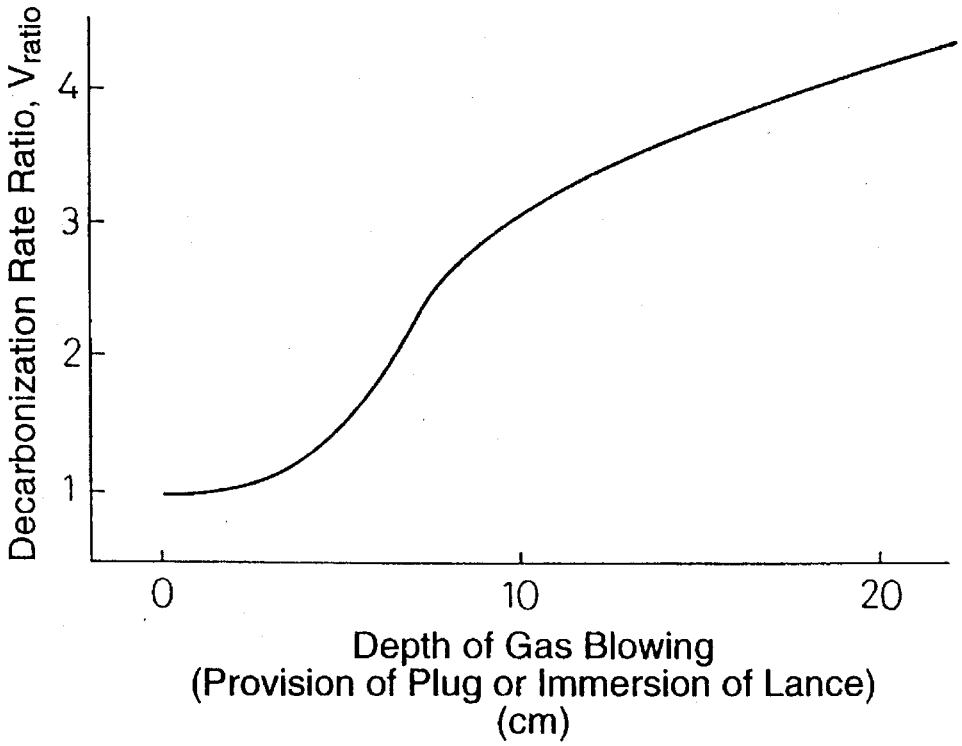
FIG. 10 is a graph showing the relationship between the decarbonization rate ratio, $V_{ratio}$, and the immersion length of a lance in Example 10.

The relationship between the decarbonization rate ratio, $V_{ratio}$, and the immersion depth of the lance is shown in FIG. 10. The decarbonization rate ratio, $V_{ratio}$, represents the ratio of the decarbonization rate, $V_{Ar+in}$, obtained in the case of a variation in the blowing depth to the decarbonization rate ratio, $V_{Ar}o_{+in}$, obtained where the blowing depth is zero, i.e., $V_{Ar+in}/V_{Ar}o_{+in}$. As apparent from the results shown in FIG. 10, the $V_{ratio}$ value becomes larger when the immersion depth of lance is 10 cm or more.

EXAMPLE 11 (Influence of Pressure)

Figure 11:
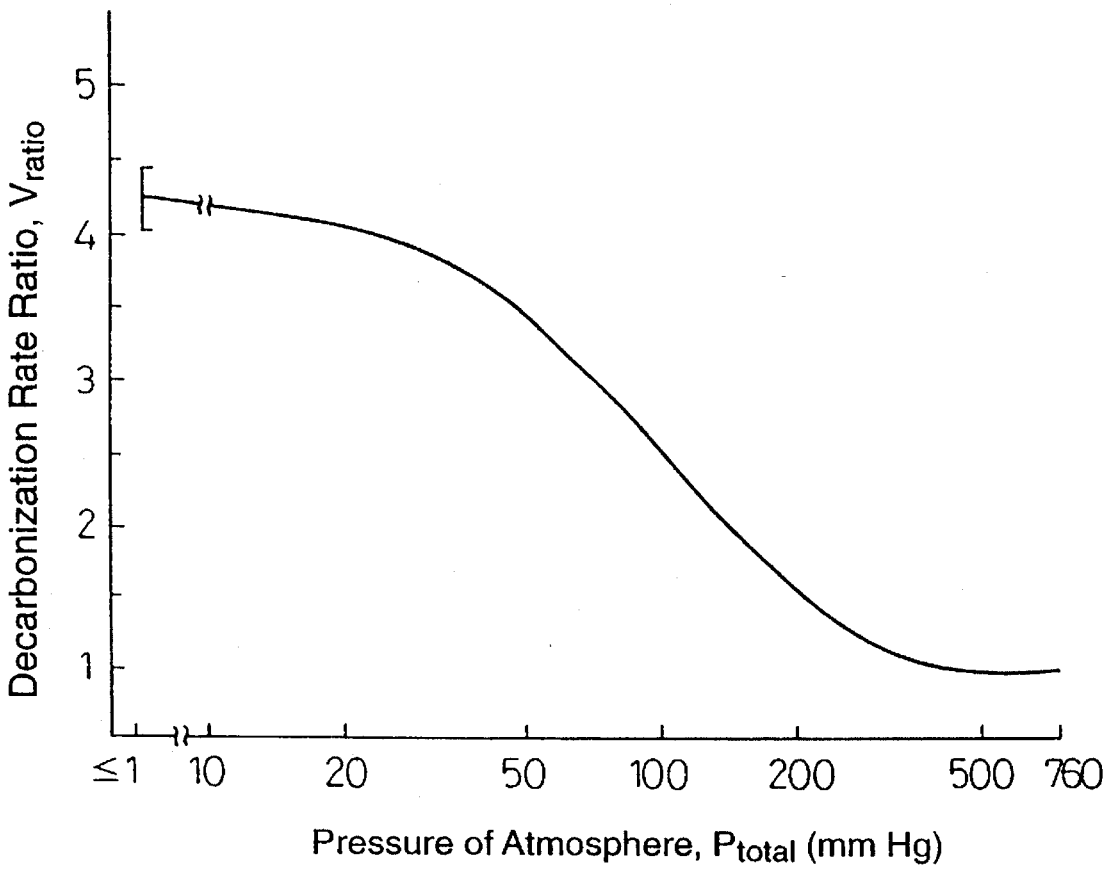
FIG. 11 is a graph showing the relationship between the decarbonization rate ratio, $V_{ratio}$, and the atmosphere pressure, $P_{total}$,in Example 11.

A container (capacity: 120 cmϕ×200 cmL) equipped with a gas blowing plug at the bottom of the container was charged with 8 tons of a molten steel having a composition comprising 0.015% by weight of carbon [C], 0.04% by weight of oxygen [O] and 0.006% by weight of sulfur [S], and the molten steel was refined by feeding Ar gas at a flow rate of 10 (N liter/min) through the plug and feeding oxygen gas through a lance (immersion depth: 40 cm) provided at the upper part of the container while conducting an electromagnetic stirring under reduced pressure (conditions: type shown in FIGS. 19(*c*), $V_{steel}$=30 cm/sec, power=800 kW). The relationship between the decarbonization rate, $V_{ratio}$, and the pressure of the atmosphere, $P_{total}$,is shown in FIG. 11. The decarbonization rate ratio, $V_{ratio}$, represents the ratio of the decarbonization rate, $V_{Ar+in}$, obtained at that time to the decarbonization rate ratio, $V_{Ar+in}$(1 atm), obtained where the pressure is 1 atm. As apparent from the results shown in FIG. 11, the $V_{ratio}$ value rapidly becomes larger when the $P_{total}$ is 300 mmHg or less.

EXAMPLE 12 (Effect of Type of Electromagnetic Stirring

A container (capacity: 120 cmϕ×200 cmL) equipped with a gas blowing plug at the bottom of the container was charged with 8 tons of a molten steel having a composition comprising 0.015% by weight of carbon [C], 0.045% by weight of oxygen [O] and 0.016% by weight of sulfur [S], and the molten steel was refined by blowing Ar gas though two plugs at a total flow rate of 20 (N liter/min) while conducting an electromagnetic stirring, with various stirring patterns as shown in FIGS. 19(*a*) to (*c*), under a reduced pressure of 20 mmHg (conditions: $V_{steel}$=30 cm/sec, power=600 kW) and feeding iron ore to the molten steel through a lance (immersion depths: −10 cm to 50 cm) provided at the upper part of the container, using Ar gas as a carrier gas.

Figure 12:
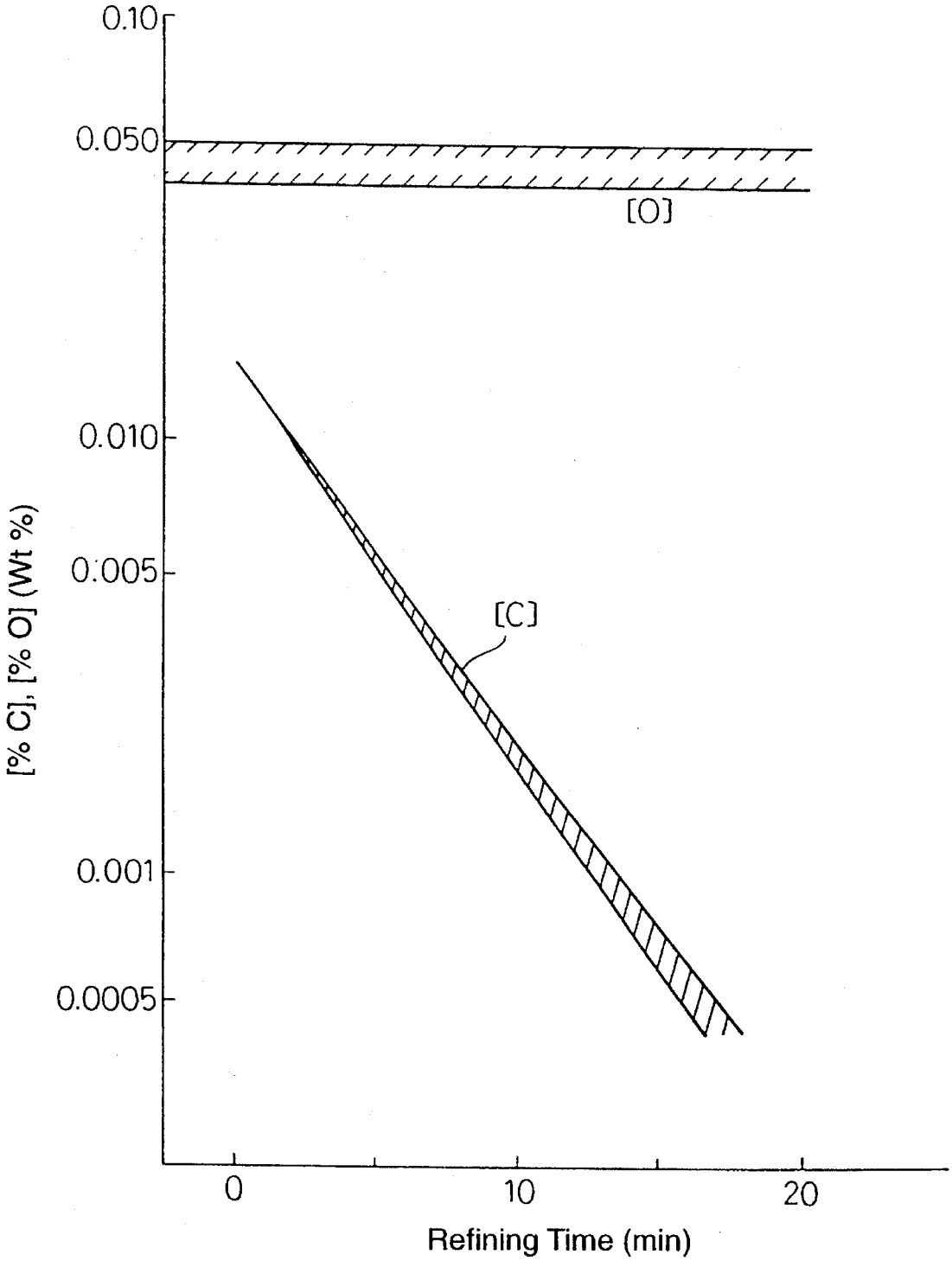
FIG. 12 is a graph showing the relationship between the refining time and the [C] content and [O] content where the electromagnetic stirring method is varied in Example 12.

The change of the [C] content and [O] content with time is shown in FIG. 12. As apparent from the results shown in FIG. 12, an extra low carbon molten steel having a [C] content of 0.0005% by weight or less was obtained by a decarbonization treatment for 20 min, regardless of the type of electromagnetic stirring method used. The resultant steel was a ultra-low nitrogen steel having an [N] content of 0.0015 to 0.0011% by weight.

EXAMPLE 13 (Steel: Alloy Steel)

A container (capacity: 120 cmϕ×200 cmL) equipped with a gas blowing plug at the bottom of the container was charged with 8 tons of a molten steel having a composition comprising 0.051% by weight of carbon [C], 0.045 to 0.025% by weight of oxygen [O] and 0.016% by weight of sulfur [S] and having a [Cr] content of 5 to 30% by weight, and 8 tons of a molten steel having a composition comprising 0.050% by weight of carbon [C], 0.040 to 0.020% by weight of oxygen [O] and 0.016% by weight of sulfur [S] and having an [Mn] content of 5 to 30% by weight, and refining was conducted by blowing Ar gas through two plugs at a total flow rate of 20 (N liter/min) while conducting an electromagnetic stirring, with various stirring patterns as shown in FIGS. 19(*a*) to (*c*), under a reduced pressure of 1 to 20 mmHg (conditions: $V_{steel}$=30 cm/sec, power=800 kW) and feeding iron ore to the molten steel through a lance provided at the upper part of the container (50 cm above the surface of the molten steel), using Ar gas as a carrier gas.

Figure 13:
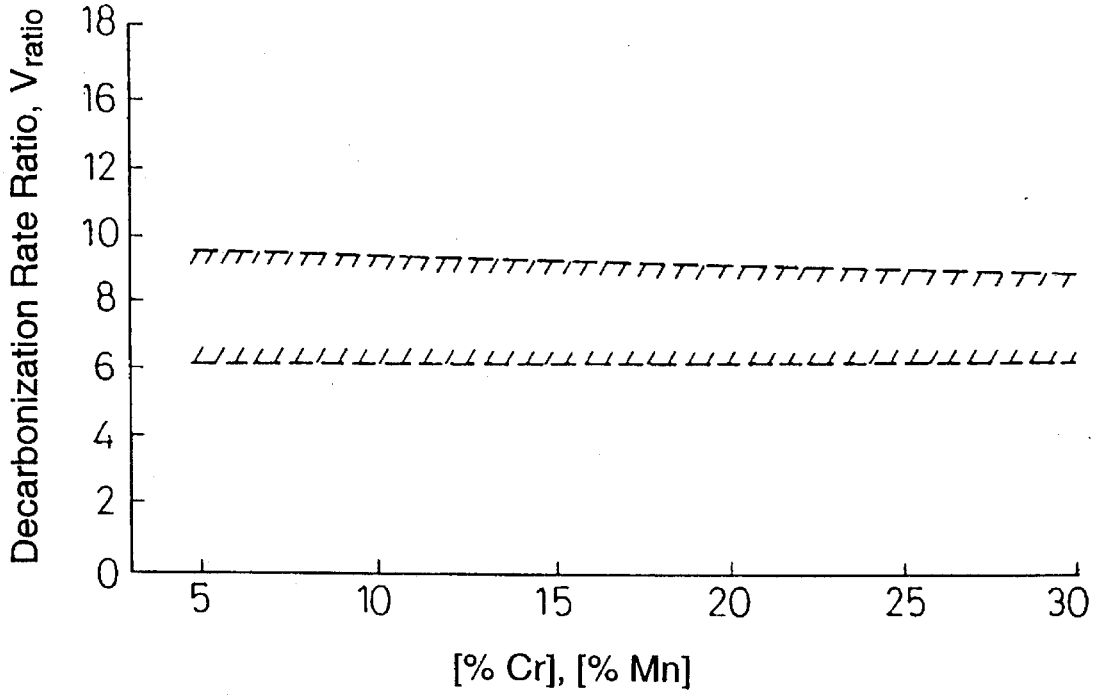
FIG. 13 is a graph showing the relationship between the decarbonization rate ratio, $V_{ratio}$, and the [Cr] content and [Mn] content where the electromagnetic stirring method is varied in Example 13.

The relationship between the decarbonization rate ratio, $V_{ratio}$, and [% Cr] and [% Mn] is shown in FIG. 13. The $V_{ratio}$ is the ratio of the decarbonization rate, $V_{Ar+in}$, obtained in the case of a combination of the electromagnetic stirring with the gas blowing to the decarbonization rate, $V_{Ar}$, obtained in the case of a gas blowing without the electromagnetic stirring. As shown in FIG. 13, the $V_{ratio}$ value is increased 6 to 10 times regardless of [% Cr] and [% Mn], i.e., the decarbonization rate is improved.

Figure 20:
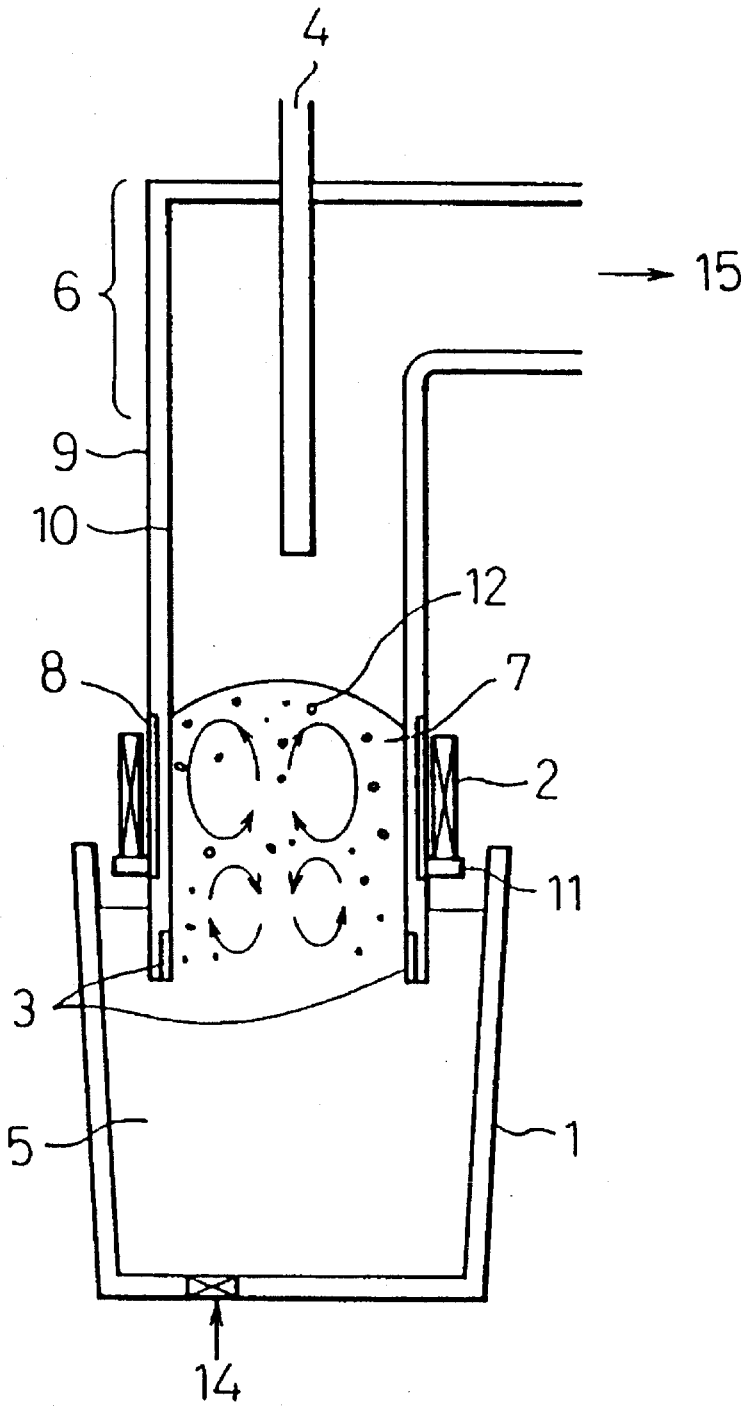
FIGS. 20 and 21 are schematic views of apparatuses for practicing the method of the present invention used in and after Example 14.
Figure 21:
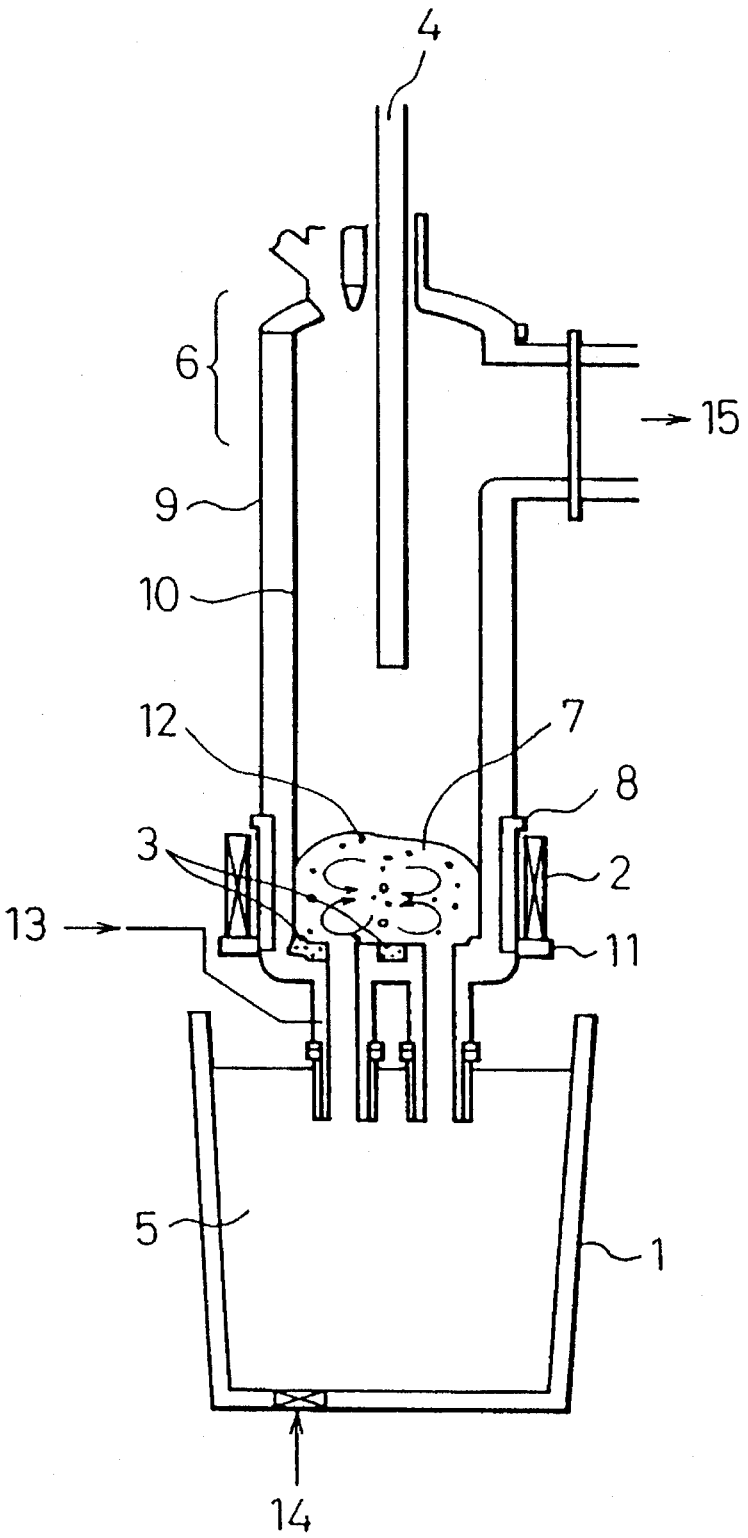

FIGS. 20 and 21 are schematic views of apparatuses for conducting the method of the present invention. Numeral 1 designates a container for accommodating a molten steel (ladle), 2 a coil for electromagnetic stirring and heating, 3 a gas blowing plug or a gas blowing nozzle, 4 a lance for blowing a gas and an oxide, 5 a molten steel to be refined, 6 a reduced pressure or vacuum tank, 7 a molten steel drawn up within the reduced pressure or vacuum tank, 8 a hermetically sealed housing comprising a nonmagnetic material, 9 a hermetically sealed housing, 10 a refractory, 11 a shield, 12 a dispersed bubble, 13 a molten steel circulation gas, and 14 a gas for stirring the molten steel contained in the ladle.

EXAMPLE 14 (Cylinder Type (Decarbonization of Common Steel))

A container (capacity: 300 cmϕ×300 cmL) equipped with a gas blowing plug at the bottom of the container was charged with 100 tons of a molten steel having a composition comprising 0.051% by weight of carbon [C], 0.04% by weight of oxygen [O] and 0.006% by weight of sulfur [S], and the molten steel was decarbonization-refined by using the refining equipment having a vacuum tank as shown in FIG. 20.

The [N] content of the molten steel before refining was 0.003 to 0.0035% by weight. The pressure within the vacuum tank reached 1 mmHg or less in 5 min after the initiation of the evacuation of the container. Five minutes after the initiation of the evacuation, Ar gas was blown through three gas blowing plugs provided on the internal wall within the vacuum tank at a total flow rate of 0 to 2000 (liter/min) while conducting an electromagnetic stirring (conditions: type shown in FIG. 19(*c*), power=2000–4000 kW). The flow rate of the molten steel, $V_{steel}$, derived from the electromagnetic stirring was 30 to 60 (cm/sec). The depth of the provision of the Ar gas blowing plugs was varied to 5, 10, 30, 100 and 130 cm.

Figure 14:
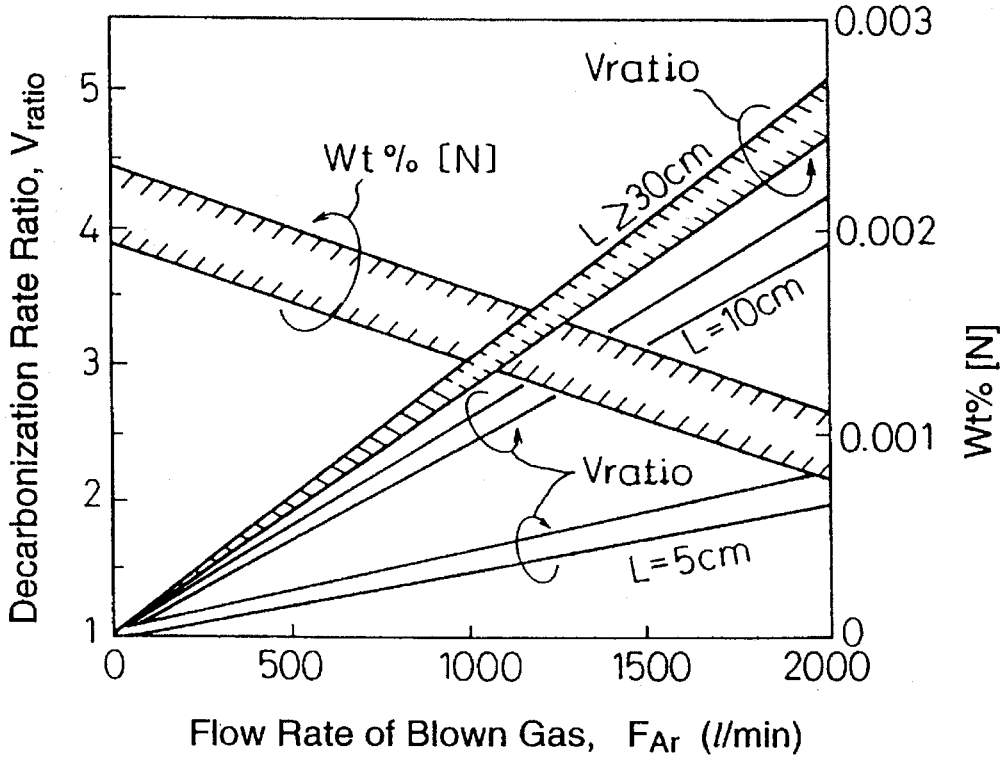
FIG. 14 is a graph showing the relationship between the flow rate, $F_{Ar}$, of a gas blown through a plug and the decarbonization rate ratio, $V_{ratio}$, and the [N] content after the refining treatment in Example 14.

The relationship between the decarbonization rate ratio, $V_{ratio}$, and the Ar gas flow rate, $F_{Ar}$ (liter/min), is shown in FIG. 14. $V_{ratio}$ represents the ratio of the decarbonization rate, $V_{Ar+in}$, obtained in the case of a combination of electromagnetic stirring with Ar blowing to the decarbonization rate, $V_{Ar}$, in the case of Ar blowing alone without electromagnetic stirring. As shown in FIG. 14, the $V_{ratio}$ rapidly increases when the depth of the plug is 10 cm or more. At that time, the $V_{ratio}$ increases with an increase in the $F_{Ar}$, which contributes to a remarkable shortening of the decarbonization treatment time.

The [N] content when the refining treatment for 25 min was completed is shown in FIG. 14, in relation to the $F_{Ar}$. As apparent from FIG. 14, the [N] content when the refining treatment was completed is lowered with an increase of the $F_{Ar}$, which enables the decarbonization to be conducted at the same time as the denitrogenation.

EXAMPLE 15 (Cylinder Type (Decarbonization of Alloy Steel))

A ladle (volume: 300 cmϕ×300 cmL) equipped with a gas blowing plug at the bottom of the container was charged with 100 tons of a molten steel having a composition comprising 0.25% by weight of carbon [C], 0.02 to 0.04% by weight of oxygen [O] and 0.006% by weight of sulfur [S] while varying the [Cr] and [Mn] contents within the range of from 5 to 30% by weight, and the molten steel was decarbonization-refined by using the refining equipment having a vacuum tank provided at the upper part of the container as shown in FIG. 20. The pressure within a vacuum tank reached 1 mmHg or less in 5 min after the initiation of the evacuation. Five minutes after the initiation of the evacuation, Ar gas was blown through a gas blowing plug provided on the internal wall within the vacuum tank at a flow rate of 1500 (liter/min) while conducting an electromagnetic stirring (conditions: type shown in FIG. 19(*c*), power=3000 kW). The flow rate of the molten steel, $V_{steel}$, derived from the electromagnetic stirring was 40 to 50 (cm/sec). In the case of a [Cr]-containing molten steel, the oxygen gas and chromium ore powder were fed alone, or in combination, to the molten steel through a lance provided at the upper part of the vacuum tank, and in the case of an [Mn]-containing molten steel, the oxygen gas and the manganese ore powder were fed alone or in combination to the molten steel. In the above-described methods, the influence of the oxygen source feeding method on the decarbonization rate was very small.

Figure 15:
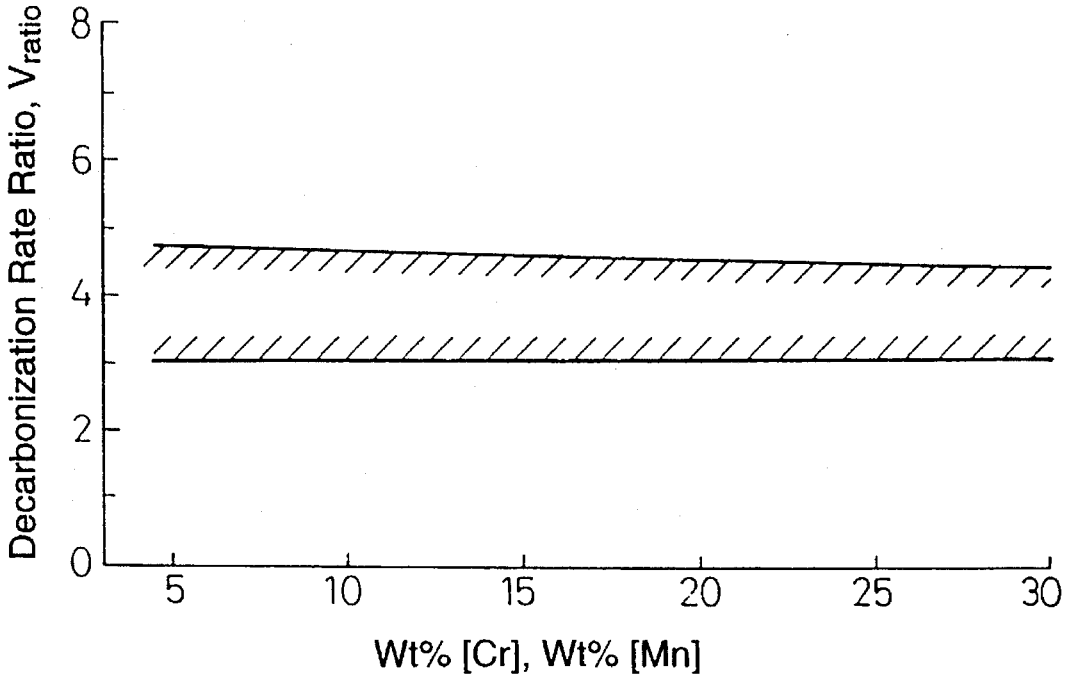
FIG. 15 is a graph showing the relationship between the decarbonization rate ratio, $V_{ratio}$, and the [Cr] content and [Mn] content in Example 15.

The relationship between the decarbonization rate ratio, $V_{ratio}$, and [Cr] content and [Mn] content is shown in FIG. 15. In FIG. 15, the decarbonization rate ratio, $V_{ratio}$, represents the decarbonization rate, $V_{Ar+in}$, obtained in the case of a combination of the electromagnetic stirring with the Ar blowing to the decarbonization rate, $V_{Ar}$, obtained in the case of the Ar blowing from the plug without the electromagnetic stirring.

As apparent from FIG. 15, regardless of the [Cr] content or [Mn] content, the electromagnetic stirring in combination with the gas blowing increased the decarbonization rate four times, compared with the use of gas blowing alone, which contributes to a remarkable shortening of the decarbonization treatment time.

EXAMPLE 16 (Cylinder Type)

A ladle (volume: 300 cmϕ×300 cmL) equipped with a gas blowing plug for stirring a molten steel at the bottom of the container was charged with 100 tons of a molten steel having a composition comprising 0.80% by weight of carbon [C], 0.35% by weight of silicon [Si] and 0.95% by weight of manganese [Mn], and the molten steel was refined by using the refining equipment having a vacuum tank provided at the upper part of the container as shown in FIG. 20. The pressure within the vacuum tank reached 1 mmHg or less in 5 min after the initiation of the evacuation. Concurrently with the initiation of the evacuation, Ar gas was blown through a blowing plug provided on the internal wall within the vacuum tank at a flow rate of 0 to 2000 (liter/min) while conducting electromagnetic stirring (conditions: type shown in FIG. 19(*b*), power=2000–4000 kW). The flow rate of the molten steel, $V_{steel}$, derived from the electromagnetic stirring was 30 to 60 (cm/sec).

Figure 16:
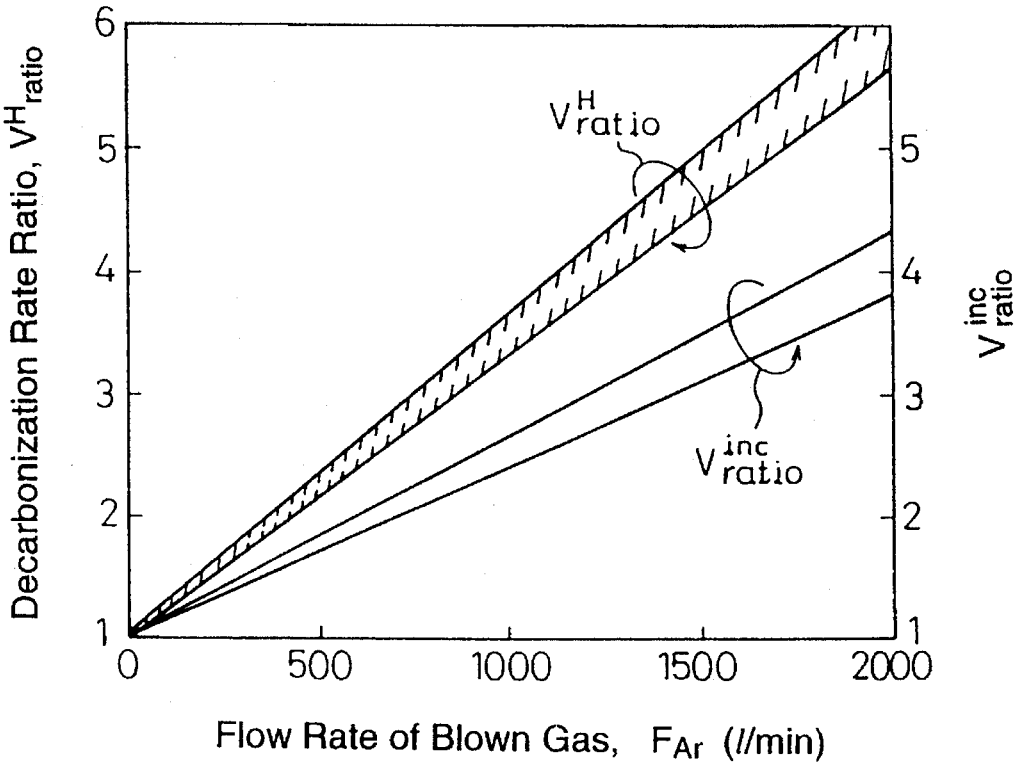
FIG. 16 is a graph showing the relationship between the inclusion removal rate ratio, $V^{inc}_{ratio}$ and the dehydrogenation rate ratio, $V^{M}_{ratio}$, and the blown Ar gas flow rate, $F_{Ar}$, in Example 16.

The relationship between the inclusion removal rate, $V^{inc}_{ratio}$, and the dehydrogenation rate ratio, $V^{H}_{ratio}$, and the Ar gas flow rate, $F_{Ar}$ (liter/min), is shown in FIG. 16. As shown in FIG. 16, the $V^{inc}_{ratio}$ represents the ratio of the inclusion removal rate, $V^{inc}_{Ar+iN}$, obtained in the case of a combination of the electromagnetic stirring with the Ar blowing to the inclusion removal rate, $V^{inc}_{Ar}$, obtained in the case of the Ar blowing through the plug without the electromagnetic stirring, and the $V^{H}_{ratio}$ represents the ratio of the inclusion removal rate, $V^{H}_{Ar+iN}$, obtained in the case of a combination of the electromagnetic stirring with the Ar blowing to the inclusion removal rate, $V^{H}_{Ar}$, obtained in the case of the Ar blowing through the plug alone.

As shown in FIG. 16, the $V^{inc}_{ratio}$ and $V^{H}_{ratio}$ increase with increasing the $F_{Ar}$. When the electromagnetic stirring was conducted simultaneously with the gas blowing, the inclusion removal rate and the dehydrogenation rate become very large, compared with the gas blowing alone, which facilitates the production of a clean steel having a low hydrogen content.

EXAMPLE 17 [RH type (Decarbonization of Common Steel)]

A ladle (volume: 300 cmϕ×300 cmL) was charged with 100 tons of a molten steel having a composition comprising 0.025% by weight of carbon [C], 0.04% by weight of sulfur [O] and 0.007% by weight of sulfur [S], and the molten steel was refined by using the refining equipment having a vacuum tank provided at the upper part of the container as shown in FIG. 21. At that time, the [N] content was 0.0030 to 0.0035% by weight. In this case, a gas blowing plug was mounted at the bottom of the vacuum tank, and an Ar gas for circulating the molten steel was blown through an immersion pipe.

The pressure within the vacuum tank reached 1 mmHg or less in 5 min after the initiation of the evacuation. Five minutes after the initiation of the evacuation, Ar gas was blown through a gas blowing plug provided at the bottom of the container at a flow rate of 0 to 2000 (liter/min) while conducting an electromagnetic stirring (conditions: type shown in FIGS. 19(*b*) and (*c*), power= 2000–4000 kW). The flow rate of the molten steel, $V_{steel}$, derived from the electromagnetic stirring was 30 to 60 (cm/sec).

Figure 17:
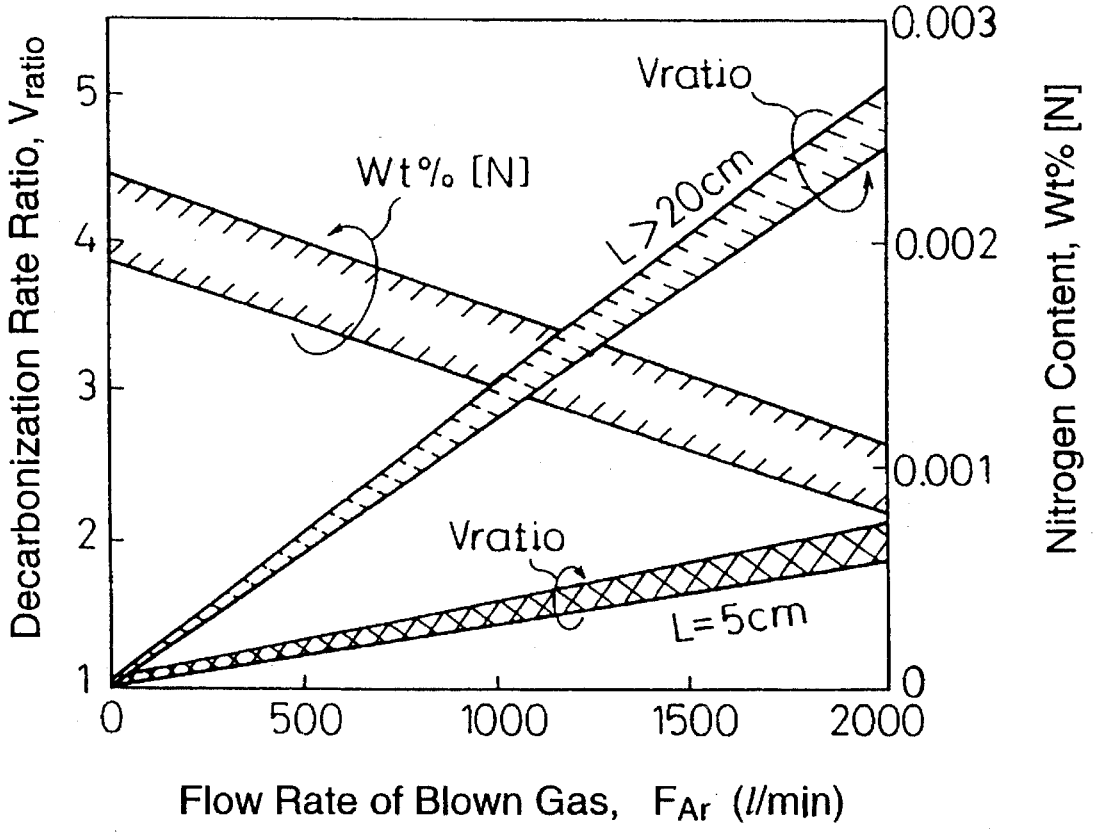
FIG. 17 is a graph showing the relationship between the flow rate, $F_{Ar}$, of a gas blown through a plug and the decarbonization rate ratio, $V_{ratio}$, and the [N] content after the refining treatment in Example 17.

The relationship between the decarbonization rate ratio and the Ar gas flow rate, $F_{Ar}$ (liter/min), is shown in FIG. 17. The decarbonization rate, $V_{ratio}$, represents the ratio of the decarbonization rate, $V_{Ar+in}$, obtained in the case of a combination of the electromagnetic stirring with the Ar blowing to the decarbonization rate, $V_{Ar}$, obtained in the case of the Ar blowing through the plug alone.

As apparent from the results shown in FIG. 17, the $V_{ratio}$ increases with an increase of the $F_{Ar}$, which enables the decarbonization treatment time to be significantly shortened.

The relationship between the [N] content and the $F_{Ar}$ when the refining treatment for 25 min was completed is shown in FIG. 17. As shown in FIG. 17, the [N] content at the time of the completion of the refining treatment is lowered with an increase in the $F_{Ar}$, which enables the decarbonization to be conducted at the same time as the denitrogenation.

As apparent from the foregoing description, according to the present invention, the combination of the electromagnetic stirring with the gas blowing enables a ultra-low carbon steel to be produced even under a pressure corresponding to the atmospheric pressure, due to the following features:

(1) the blown gas is carried away by the flow of the molten steel, by an electromagnetic stirring, and finely dispersed within the molten steel to thus increase the gas-liquid reaction interface area; and (2) a fine bubble is carried on the flow of the molten steel caused by the electromagnetic stirring, to thereby increase the residence time in the molten metal.

We claim:

1. A method of refining a molten metal or a molten alloy in a refining container having a shaft with a center through degassing, comprising blowing a gas into the molten metal or the molten alloy contained within the refining container, with the blowing position offset from the center of the shaft of the refining container, while stirring by utilizing an electromagnetic force, to superimpose the blown gas onto the molten metal or the molten alloy, and the stirring by the electromagnetic force refines the blown gas, and at the same time, increases the residence time of the blown gas in the molten metal or molten alloy bath, and homogeneously disperses the blown gas in the molten metal or molten alloy bath.

2. A method of refining a molten metal or a molten alloy through degassing, comprising blowing a gas into a molten metal or a molten alloy contained within a refining container having a plug or a lance disposed in the molten metal or molten alloy, said plug or said lance having an ejection end for ejecting blown gas located at a depth below a free surface of the molten metal or molten alloy, wherein the depth of the ejection end of the plug or the lance is 10 cm or more from the free surface of the molten metal or molten alloy, while stirring by utilizing an electromagnetic force, to superimpose the blown gas onto the molten metal or the molten alloy, and the stirring by the electromagnetic force refines the blown gas, and at the same time, increases the residence time of the blown gas in the molten metal or molten alloy bath, and homogeneously disperses the blown gas in the molten metal or molten alloy bath.

3. A method of refining a molten metal or a molten alloy through degassing, comprising blowing a gas into a molten metal or a molten alloy contained within a refining container, while stirring by utilizing an electromagnetic force, wherein electric power is applied to electromagnetically stir the molten metal or molten alloy in the container at a rate of 20 cm/sec or more to superimpose the blown gas onto the molten metal or the molten alloy, and the stirring by the electromagnetic force refines the blown gas, and at the same time, increases the residence time of the blown gas in the molten metal or molten alloy bath, and homogeneously disperses the blown gas in the molten metal or molten alloy bath.

4. A method of refining a molten metal or a molten alloy to extra low carbon content through decarbonization, comprising conducting the decarbonization under a reduced pressure or a vacuum while blowing an inert gas or a mixed gas comprising an inert gas, and added thereto, an oxygen-containing gas, through a lance or a plug into a molten metal or a molten alloy contained within a refining container, wherein the decarbonization is conducted by using an apparatus equipped with a reduced pressure or vacuum tank on the upper part of a ladle for accommodating the molten metal or the molten alloy, in such a manner that a part of the molten metal or molten alloy to be decarbonized is drawn up to the reduced pressure or vacuum tank, the molten metal or molten alloy to be refined is circulated or moved through the ladle and the reduced pressure or vacuum tank, and the inert gas or the mixed gas comprising an inert gas, and added thereto, the oxygen-containing gas, is blown into the molten metal or molten alloy within the reduced pressure or vacuum tank while subjecting the molten metal or molten alloy draw up to the reduced pressure or vacuum tank to an electromagnetic stirring.

5. A method according to claim 4, wherein a porous plug or a porous nozzle is buried in the internal wall of the reduced pressure or vacuum tank and at least part of the blown gas is blown through the porous plug or porous nozzle.

6. A method of refining a molten metal or a molten alloy through denitrogenation, comprising conducting the denitrogenation of molten metal or molten alloy while stirring by an electromagnetic force and blowing an inert gas alone or an oxygen-containing inert gas into the molten metal or the molten alloy contained within a refining container, wherein the electromagnetic stirring superimposes the blown gas onto the molten metal or molten alloy, refines the blown gas, and increases the residence time of the blown gas in the molten metal or molten alloy, and homogeneously disperses the blown gas in the molten metal or molten alloy.

7. A method according to claim 6, wherein the denitrogenation is conducted by using an apparatus equipped with a reduced pressure or vacuum tank on the upper part of a ladle for accommodating a molten metal or a molten alloy in such a manner that part of the molten metal or molten alloy to be treated is drawn up to the reduced pressure or vacuum tank, the molten metal or molten alloy to be treated is circulated or moved through the ladle and the reduced pressure or vacuum tank, and in this state, the inert gas or the mixed gas comprising an inert gas, and added thereto, an oxygen-containing gas, is blown into the molten metal or molten alloy within the reduced pressure or vacuum tank while subjecting the molten metal or molten alloy drawn up to the reduced pressure or vacuum tank to an electromagnetic stirring.

8. A method according to claim 7, wherein a porous plug or a porous nozzle is buried in the internal wall of the reduced pressure or vacuum tank and at least part of the blown gas is blown through the porous plug or porous nozzle.

9. A method of refining a molten metal or a molten alloy through dehydrogenation, comprising conducting the dehydrogenation of molten metal or molten alloy under stirring by an electromagnetic force while blowing an inert gas alone or a mixed gas comprising an inert gas, and added thereto, an oxygen-containing gas, into the molten metal or the molten alloy contained within a refining container, wherein the electromagnetic stirring superimposes the blown gas onto the molten metal or molten alloy, refines the blown gas, and increases the residence time of the blown gas in the molten metal or molten alloy, and homogeneously disperses the blown gas in the molten metal or molten alloy.

10. A method according to claim 9, wherein the dehydrogenation is conducted by using an apparatus equipped with a reduced pressure or vacuum tank on the upper part of a ladle for accommodating a molten metal or a molten alloy in such a manner that part of the molten metal or molten alloy to be treated is drawn up to the reduced pressure or vacuum tank, the molten metal or molten alloy to be treated is circulated or moved through the ladle and the reduced pressure or vacuum tank, and in this state, the inert gas or the oxygen-containing inert gas is blown into the molten metal or molten alloy within the reduced pressure or vacuum tank while subjecting the molten metal or molten alloy drawn up to the reduced pressure or vacuum tank to an electromagnetic stirring.

11. A method according to claim 10, wherein a porous plug or a porous nozzle is buried in the internal wall of the reduced pressure or vacuum tank and at least part of the blown gas is blown through the porous plug or porous nozzle.

* * * * *

UNITED STATES PATENT AND TRADEMARK OFFICE

CERTIFICATE OF CORRECTION

PATENT NO. : 5,454,854

DATED : October 3, 1995

INVENTOR(S) : Kazuumi HARASHIMA, et al.

It is certified that error appears in the above-indentified patent and that said Letters Patent is hereby corrected as shown below:

Title page, item [63] after "828,973" insert --filed January 1, 1992 and--.

Column 1, line 5, after "07/828,973" insert --filed January 1, 1992 and--.

Column 2, line 26, change "a" to --an-- before "ultra-low" (both occurrences).

Column 2, line 42, change "a" to --an-- before "ultra-low" (both occurrences).

Column 2, line 45, change "62 62-156220" to --62-156220--.

Column 2, line 47, change "decabonization," to --decarbonization,--.

Column 7, line 2, change "Bloom" to --Blown--.

Column 7, line 9, change "bloom" to --blown--.

Column 8, line 51, change "a" to --an-- before "ultra-low".

UNITED STATES PATENT AND TRADEMARK OFFICE

CERTIFICATE OF CORRECTION

PATENT NO. : 5,454,854

DATED : October 3, 1995

INVENTOR(S) : Kazuumi HARASHIMA, et al.

It is certified that error appears in the above-indentified patent and that said Letters Patent is hereby corrected as shown below:

Column 9, line 5, change "$V_{AR}$" to --$V_{Ar}$--.

Column 9, line 6, change "$V_{Ar}$[illegible]" to --$V_{Ar}$[illegible]--.

Column 9, line 27, change "a" to --an-- before "ultra-low".

Column 10, line 41, change "FIGS." to --FIG.--.

Column 11, line 57, change "a" to --an-- before "ultra-low".

Column 15, line 6, change "a" to --an-- before "ultra-low".

Column 16, line 11, change "draw" to --drawn--.

Signed and Sealed this

Second Day of April, 1996

*Attest:*

*Attesting Officer*

BRUCE LEHMAN

*Commissioner of Patents and Trademarks*